US007475496B2

(12) United States Patent
Mueller

(10) Patent No.: US 7,475,496 B2
(45) Date of Patent: Jan. 13, 2009

(54) STEAM BLOWER BOX UNIT

(75) Inventor: Dieter Mueller, Sontheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 133 days.

(21) Appl. No.: 10/980,741

(22) Filed: Nov. 3, 2004

(65) Prior Publication Data

US 2005/0097774 A1 May 12, 2005

Related U.S. Application Data

(63) Continuation of application No. PCT/EP03/04580, filed on Apr. 30, 2003.

(30) Foreign Application Priority Data

May 7, 2002 (DE) ..... 102 20 377

(51) Int. Cl.
*F26B 13/06* (2006.01)
*F26B 9/00* (2006.01)

(52) U.S. Cl. ..... 34/629; 34/631; 34/222; 34/119; 34/124

(58) Field of Classification Search ..... 34/404, 34/411, 83, 549, 618, 623, 624, 629, 631, 34/222, 117, 119, 120, 122, 124
See application file for complete search history.

(56) References Cited

U.S. PATENT DOCUMENTS 3,052,991 A * 9/1962 Goldner ..... 34/89
4,192,711 A * 3/1980 Tapio et al. ..... 162/199

FOREIGN PATENT DOCUMENTS

DE 19909588 A1 * 9/2000
WO WO 96/22421 7/1996
WO WO 99/41450 8/1999

* cited by examiner

*Primary Examiner*—Jiping Lu
(74) *Attorney, Agent, or Firm*—Taylor & Aust, P.C.

(57) ABSTRACT

A steam blower box unit having a steam blower box for applying steam to a passing material web, especially a paper or board web, and having a withdrawal device at least partly integrated in the steam blower box. The steam blower box, located opposite the material web in an operating position, can be moved out of its operating position laterally via the withdrawal device, that is to say generally transversely with respect to the web running direction, and can be moved into this operating position again from its lateral position. In this case, preferably the entire steam blower box can be moved appropriately via the withdrawal device.

28 Claims, 17 Drawing Sheets

STEAM BLOWER BOX UNIT

CROSS REFERENCE TO RELATED APPLICATIONS

This is a continuation of PCT application No. PCT/EP03/04580, entitled "STEAM BUBBLE BOX UNIT", filed Apr. 30, 2003.

BACKGROUND OF THE INVENTION

1. Field of the Invention

The present invention relates to a steam blower box unit having a steam blower box for applying steam to a passing material web, especially a paper or board web, and, more particularly, the present invention also relates to a method for moving a steam blower box out of its operating position.

2. Description of the Related Art

Steam blower boxes are used in papermaking. They are used in particular to increase the temperature of the material web with the aid of the steam applied to the material web, in order to improve the dewatering of the material web. In this case, a respective steam blower box offers the possibility of influencing the cross-machine moisture profile of the material web by way of the sectional application of steam transversely with respect to the web running direction. Such a steam blower box is described, for example, in WO 99/41450.

Hitherto, withdrawal rails and a withdrawal carriage have generally been used for a respective removal of the entire steam blower box. However, such a removal is relatively time-consuming and entails specific expenditure on additional parts. Such a method is problematic, in particular in installations having a guide roll which cannot be lowered.

It has been proposed to withdraw only the internal fittings of the steam blower box, including valves and zone chambers. Since, in this case, the housing having the steam outlet holes remains within the papermaking machine, these are accessible only with difficulty for cleaning.

What is needed in the art is an improved steam blower box unit and an improved method of moving the steam blower box with which rapid withdrawal, for example within one hour, and complete maintenance are ensured, in which cleaning of all the regions of the steam blow box and rapid replacement of defective parts is possible without difficulty.

SUMMARY OF THE INVENTION

The present invention provides an improved steam blower box unit and an improved method of moving the steam blower box with which rapid withdrawal, for example within one hour, and complete maintenance are ensured, in which cleaning of all the regions of the steam blow box and rapid replacement of defective parts is possible without difficulty.

The invention comprises, in one form thereof a steam blower box unit having a steam blower box for applying steam to a passing material web, especially a paper or board web, and having a withdrawal device at least partly integrated in the steam blower box. The steam blower box, located opposite the material web in an operating position, can be moved out of its operating position laterally via the withdrawal device, that is to say generally transversely with respect to the web running direction, and can be moved into this operating position again from its lateral position. In this case, preferably the entire steam blower box can be moved appropriately via the withdrawal device.

On account of this construction, very rapid removal of the entire steam blower box is possible, which denotes that the advantages of the previously mentioned known or proposed units are combined but their disadvantages are avoided. Since the entire steam blower box can preferably be moved out, the respective maintenance and/or cleaning work can then be carried out without difficulty. Since no parts remain within the papermaking machine, all the regions are freely accessible. The number of wearing parts is reduced to a minimum.

In a preferred practical embodiment of the steam blower box unit according to the present invention, the withdrawal device includes a withdrawal aid which can be inserted into the steam blower box and by which the steam blower box is guided as it is moved out and moved in. The withdrawal aid advantageously has an elongated shape and, in the inserted state, can in particular extend generally transversely with respect to the web running direction.

If the steam blower box is, for example, arranged opposite a suction roll, then it can be moved out at least substantially parallel to this suction roll. This brings with it the advantage that respective removal is even possible during operation.

The withdrawal aid can be inserted into the steam blower box in order to move the steam blower box out and/or in and then removed again. In principle, however, a design in which the withdrawal aid remains inserted in the steam blower box even during operation of the latter is also conceivable. The last-named embodiment brings with it inter alia the advantage of a reduced changeover time.

In a preferred practical embodiment of the steam blower box unit according to the present invention, the withdrawal aid can be inserted into a steam distribution chamber, in particular a steam pipe, belonging to the steam blower box and extending generally transversely with respect to the web running direction.

In specific cases, it may also be advantageous if the withdrawal aid can be inserted into an additional removal pipe belonging to the steam blower box and extending generally transversely with respect to the web running direction. Such a removal pipe can therefore in particular also be provided in addition to a steam pipe that is already present.

The steam blower box is advantageously designed in such a way that its upper part is available as a space for the withdrawal aid. The withdrawal aid can advantageously include a withdrawal pipe.

In an expedient embodiment, the withdrawal pipe and the relevant holder, that is to say the region of the steam blower box that accommodates the withdrawal pipe, can be of spherical design. It is also advantageous in particular if the steam blower box is provided in each case on the operator side and support side with a spherical supporting pipe which is held in a respective mounting, the running surfaces of the mountings preferably having a shape complementary to the spherical supporting pipes. The spherical shape of the operator-side and drive-side supporting pipe and of the steam blower box have the advantage that, even following rotation of the supporting pipes relative to the steam blower box about a common center, which may be necessary for the purpose of correct setting of the steam blower box relative to a suction roll, for example, appropriate centering is maintained.

In a preferred alternative embodiment of the steam blower box unit according to the present invention, the steam blower box includes a support which extends generally transversely with respect to the web running direction and is preferably T-shaped in cross-section. In this case, a withdrawal aid interacting with this support is provided in order to move the steam blower box out and in.

Running rollers or the like are advantageously provided between the withdrawal aid and the wall of the steam distribution chamber or the support. These can be, for example, spherical rollers. For example in the case of a withdrawal pipe, a plurality of rows of running rollers distributed over the pipe circumference and extending respectively in the longitudinal direction of the pipe can be provided.

The withdrawal aid can preferably be inserted into an upper region of the steam blower box. Expediently, therefore, the zonal steam guidance is arranged in such a way that the upper region of the steam blower box can be used simultaneously as a steam chamber and a withdrawal system.

The steam blower box can preferably be withdrawn in the direction of the operator side. In this case, it is in particular also advantageous if the withdrawal aid can be fixed axially, in particular to the upper part of a drive-side mounting. The axially fixed withdrawal aid can simultaneously be secured against rotation about its longitudinal axis.

It is also advantageous in particular if the axially fixed withdrawal aid can simultaneously be pivoted about a preferably horizontal axis which is perpendicular to its longitudinal axis. The risk of tilting and/or bending of the entire system including steam blower box/withdrawal aid is therefore reduced to a minimum.

The steam blower box is preferably provided with an operator-side connection, to which a crane, a winch and/or the like can advantageously be connected.

The withdrawal device can in particular also include a pulling-out cable, a deflection cable in particular guided over deflection rollers fixed to the withdrawal aid, and/or a pulling-in cable.

According to a further expedient embodiment of the steam blower box unit according to the present invention, the steam blower box can be moved out and in via a rack mechanism. In this case, a rack with which a driven pinion can be brought into engagement can be provided, for example, on the underside of the steam blower box and/or, for example, on the underside of a supporting pipe assigned to the steam blower box on the operator side.

For maintenance purposes, for example, demountable steam outlet plates can also be provided. However, these are not imperative. In addition, a mounting such that the steam blower box has to be raised only by a few millimeters, for example 10 mm, is also conceivable, in order to permit rapid removal. For this purpose, the simplest possible adjustment capability is expediently provided.

In a further advantageous embodiment of the steam blower box unit according to the present invention, the withdrawal pipe is used simultaneously for the steam feed. In this case, the withdrawal pipe preferably remains inserted in the steam blower box even during the operation of the latter.

The withdrawal pipe can expediently be inserted into a supporting pipe belonging to the steam blower box and extending generally transversely with respect to the web running direction. In this case, the region between the withdrawal pipe and the supporting pipe is preferably sealed off by way of an inflatable ring seal. It is therefore no longer necessary for any flange connections to be released.

The steam feed can be carried out, for example, from a steam connection into the withdrawal pipe, through holes in the withdrawal pipe into the region between the withdrawal pipe and the supporting pipe, through holes in the supporting pipe into a steam distribution chamber and via zone regulating valves into the corresponding zone chambers.

In a further preferred practical embodiment of the steam blower box unit according to the present invention, the steam blower box is provided in each case on the operator side and/or drive side with a supporting element which, in operation, rests on an operator-side or drive-side sliding rail. The sliding rail can in this case be assigned in particular to an operator-side or drive-side mounting, preferably being firmly connected to the operator-side or drive-side mounting.

The steam blower box can be adjusted on the sliding rails, for example between an operating position placed closer to the passing material web and a maintenance position further removed from this material web. Via these sliding rails, the steam blower box can therefore, for example, be moved closer to a suction roll or removed further from the latter.

In order to adjust the steam blower box between the operating position and the maintenance position, an actuating device in particular including at least one piston/cylinder unit can be provided, at least on the operator side. Such an operator-side actuating device can expediently be connected to the operator-side supporting element.

At least one frame-like sliding rail is advantageously provided. The supporting elements can in each case be designed as a supporting pipe, for example. In a preferred practical embodiment, a lifting frame provided with at least one running roller is provided on the operator side and can be raised in such a way that the running roller comes into contact with the operator-side supporting element and lifts the operator-side supporting element off the operator-side sliding rail. Here, the operator-side lifting frame can expediently be raised by an actuating device in particular including at least one piston/cylinder unit. The operator-side lifting frame can expediently be adjusted relative to the operator-side mounting.

In an expedient practical embodiment, guide elements firmly connected to the operator-side lifting frame are guided in guides which are in particular U-shaped in cross-section. These can in particular be firmly connected to the operator-side mounting.

The operator-side supporting element expediently rolls on the running roller assigned to the operator-side lifting frame as the steam blower box is moved out laterally, generally transversely with respect to the web running direction, from its operating or maintenance position, and as it is moved in again. In this case, preferably at least two running rollers are assigned to the operator-side lifting frame.

The operator-side mounting can be provided, for example, with an upper part which can be dismantled, in particular in order to move the steam blower box out laterally. In particular to move the steam blower box out laterally, the connection between the steam blower box or the operator-side supporting element and the operator-side actuating device can also be released.

In order to adjust the steam blower box between the operating position and the maintenance position, an actuating device in particular including at least one piston/cylinder unit is expediently provided, at least on the drive side. This drive-side actuating device can expediently be connected to the drive-side supporting element.

On the drive side, a lifting frame is preferably provided, which can be raised in such a way that the drive-side supporting element connected to it is lifted off the drive-side sliding rail. In this case, as the drive-side lifting frame is raised, at the same time in particular the drive-side end of the withdrawal aid provided with running rollers is also raised, at least an upper running roller of the withdrawal aid coming into contact with the inner wall of the steam distribution chamber or of the additional removal pipe. As the drive-side lifting frame is raised, the entire drive-side end of the steam blower box is preferably finally also raised.

In a preferred practical embodiment of the steam blower box unit according to the present invention, as the drive-side lifting frame is raised, a locking pin which passes through the drive-side end of the withdrawal aid and is guided in slots in the drive-side mounting is acted on or carried along, and the drive-side end of the withdrawal aid is also raised via this locking pin.

The drive-side lifting frame can expediently be raised by an actuating device in particular comprising at least one piston/cylinder unit. The drive-side lifting frame can expediently be adjusted relative to the drive-side mounting. In particular in order to move the steam blower box out laterally, the connection between the steam blower box or the drive-side supporting element and the drive-side actuating device can expediently be released.

According to the present invention, the advantages mentioned at the beginning is, moreover, achieved by a method of moving a steam blower box out of its operating position opposite a material web to be treated. A withdrawal device at least partly integrated in the steam blower box is used in order to move the steam blower box out laterally, that is to say generally transversely with respect to the web running direction, from the operating position and then to move it back into this operating position again. Advantageous refinements of the method according to the invention are specified in the dependent claims.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
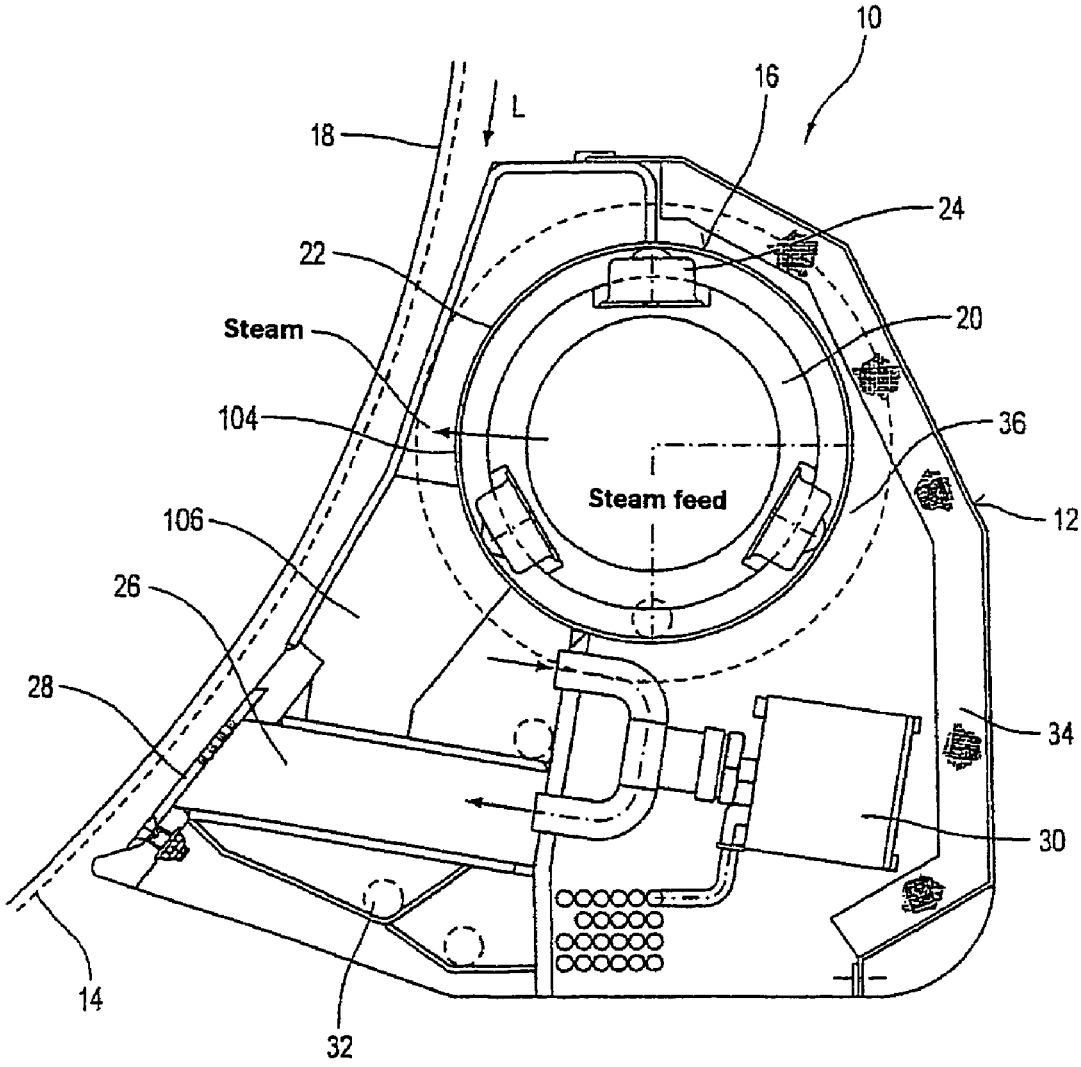
FIG. 1 is a schematic cross-sectional view of an embodiment of a steam blower box unit including a steam blower box and a withdrawal device at least partly integrated in the steam blower box, the withdrawal aid provided being a withdrawal pipe which can be inserted into a steam pipe of the steam blower box, according to the present invention.

Referring now to the drawings, and more particularly to FIG. 1, there is shown in a schematic cross-sectional illustration a steam blower box unit 10 having a steam blower box 12 for applying steam to a passing material web 14 and having a withdrawal device 16 at least partly integrated in steam blower box 12.

Material web 14 can in particular be a paper or board web. In the present case, material web 14, for example with at least one felt (not shown), is guided over a suction roll 18, opposite which steam blower box 12 is arranged during operation.

Withdrawal device 16 includes a withdrawal pipe 20 serving as a withdrawal aid, which can be inserted into a steam pipe 22 belonging to steam blower box 12. Via this withdrawal device 16 including the withdrawal pipe 20 and steam pipe 22, steam blower box 12, which is opposite the suction roll 18 and therefore material web 14 when in an operating position, can be moved out of its operating position laterally, that is to say generally transversely with respect to the web running direction L and parallel to suction roll 18 and, in a corresponding way, can be moved from a relevant lateral position into this operating position again. In the process, the entire steam blower box 12 can be moved appropriately via withdrawal device 16.

As can be seen from FIG. 1, running rollers 24, for example spherical rollers, are provided between withdrawal pipe 20 and the inner wall of steam pipe 22. Withdrawal pipe 20 extends generally transversely with respect to web running direction L and parallel to suction roll 18 when in the inserted state.

In order to move steam blower box 12 out and/or in, withdrawal pipe 20 can, for example, be inserted into steam blower box 12 and subsequently removed again. However, it is also possible for withdrawal pipe 20 to remain inserted in steam blower box 12 even during the operation of the latter.

In the present case, therefore, steam pipe 22 forming a steam distribution chamber extending generally transversely with respect to web running direction L and withdrawal pipe 20 interact in such a way that, as steam blower box 12 is moved out or in, the latter is guided appropriately by withdrawal pipe 20.

Steam blower box 12 includes a large number of zone chambers 26 lined up in a row over the web width, which are bounded toward suction roll 18 by demountable steam outlet plates 28, for example. Through a plurality of holes 104 arranged over the width, the steam from steam pipe 22 passes into a further steam distribution chamber 106 and there is allocated to zone chambers 26 via actuating valves 30.

In FIG. 1, it is moreover possible to see an actuating valve 30, for example a pneumatic actuating valve 30, by which a respective zone chamber 26 can be supplied appropriately with steam. Steam blower box 12 can additionally be provided with dewatering devices 32.

In FIG. 1, moreover, operator-side insulation 34 and an operator-side blind flange 36 of steam blower box 12 can be seen. Steam pipe 22 therefore simultaneously fulfills a steam distribution function and a supporting or static function.

Figure 2:
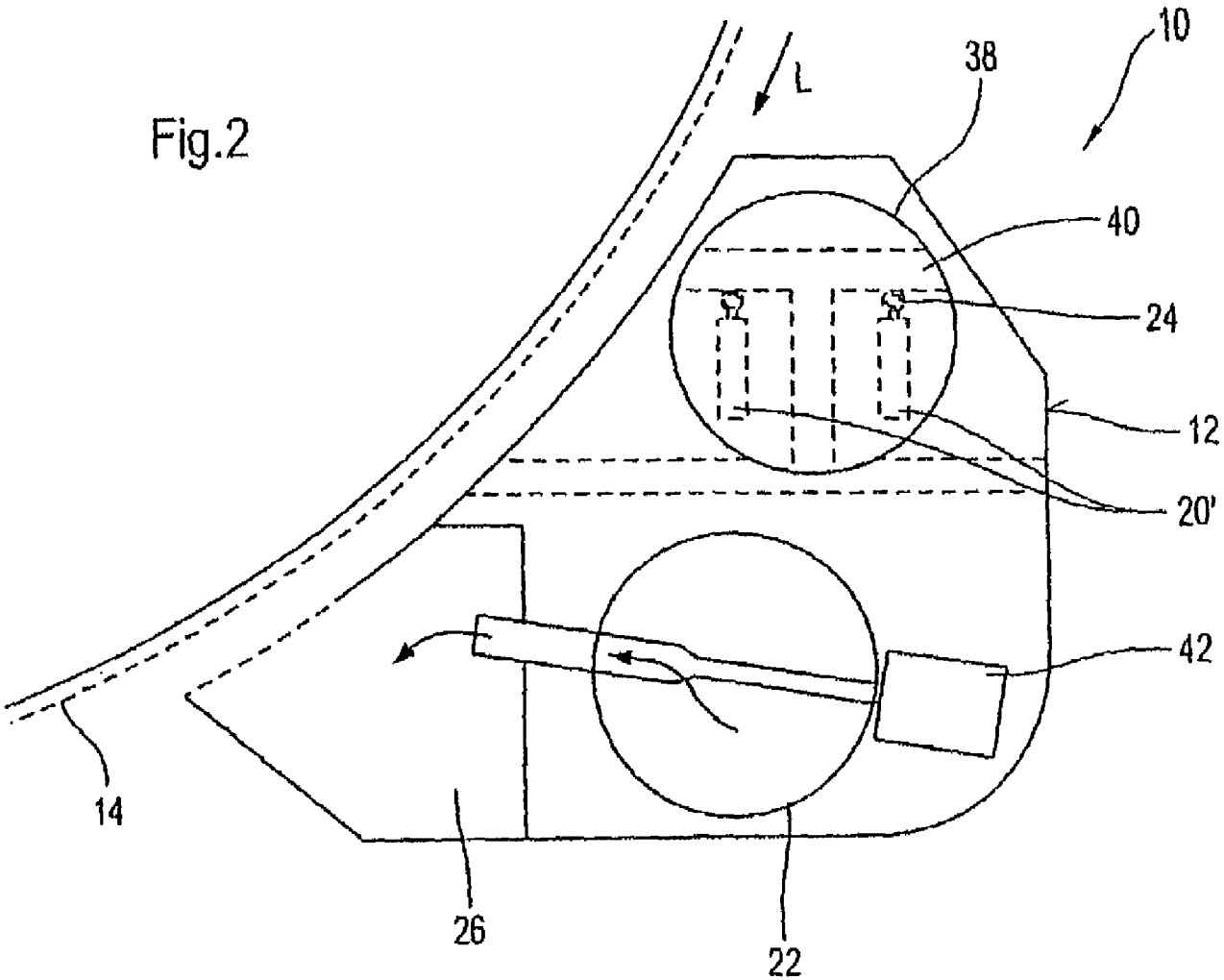
FIG. 2 is a schematic cross-sectional view of a further embodiment of the steam blower box unit, it being possible for the withdrawal aid provided again to be a withdrawal pipe, for example, but which here can be inserted into a withdrawal pipe belonging to the steam blower box and provided in addition to the steam pipe or, for example, it being possible to use a withdrawal aid which interacts with a support, for example a T-shaped support, in the steam blower box, according to the present invention.
Figure 3:
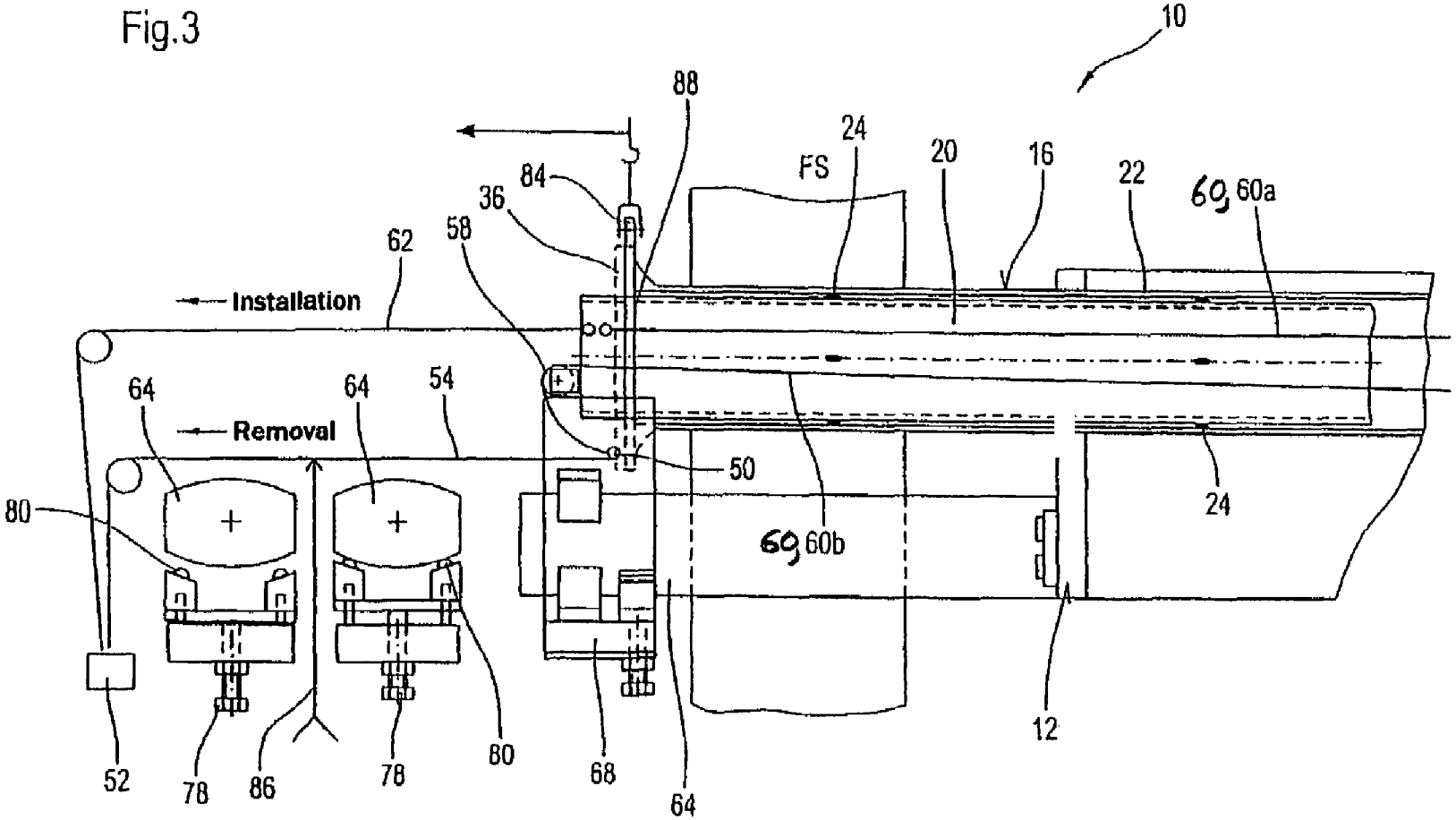
FIG. 3 is a schematic view of the operator-side end of a further embodiment of the steam blower box unit, according to the present invention.

FIG. 2 shows a further embodiment of steam blower box unit 10 in a schematic cross-sectional illustration. According to this, the withdrawal aid, for example again formed by a withdrawal pipe 20 (see also FIG. 1) which can for example also be inserted into a withdrawal pipe 38 belonging to the steam blower box 12, extending generally transversely with respect to the web running direction L and provided in addition to steam pipe 22.

In accordance with an alternative embodiment likewise indicated in FIG. 2, steam blower box 12 can, for example, also include a support 40 which extends generally transversely with respect to web running direction L and is preferably T-shaped in cross-section. In this case, a withdrawal aid 20' interacting with support 40 in order to move steam blower box 12 out and in is provided. This can include, for example, two rods or the like extending in the transverse direction, on which support 40 is again supported, for example via running rollers 24.

In the present case, too, a plurality of zone chambers 26 following one another in the transverse direction are again provided. Zone chambers 26 are connected to steam pipe 22 via valves 42.

Withdrawal pipe 20 and the relevant holder of steam blower box 12, that is to say for example the steam pipe 22 (see FIG. 1) or the additional removal pipe 38 (see FIG. 2) can, for example, also be spherical, which results in appropriate centering.

As can be seen from FIGS. 1 and 2, withdrawal aids 20, 20' can in particular be inserted into an upper region of steam blower box 12. In a corresponding way, therefore, steam pipe 22 (see FIG. 1) or the additional removal pipe 38 (see FIG. 2) can be arranged in an upper region of steam blower box 12, while zone chambers 26 are provided in a lower region.

As in particular also shown in FIGS. 3-6, steam blower box 12 can in particular be withdrawable in the direction of the operator side (FS).

FIGS. 3-6 show, in a schematic partial illustration, an embodiment of steam blower box unit 10 in which the withdrawal aid, just as in the embodiment of FIG. 1, is again formed by a withdrawal pipe 20 that can be inserted into a steam pipe 22.

In the present embodiment, withdrawal pipe 20 serving as a withdrawal aid can be fixed axially, for example to upper part 44 of a drive-side mounting 46. At the same time, the axially fixed withdrawal pipe 20 can be secured against rotation about its longitudinal axis. This is achieved by way of a pin 48, as a result of which withdrawal pipe 20 can additionally be pivoted about an axis perpendicular to its longitudinal axis, horizontal here.

Moreover, steam blower box 12 can be provided with an operator-side connection 50, to which for example a crane, a winch 52 and/or the like can be connected.

As can be seen from FIGS. 3-6, withdrawal device 16 can, for example, also include a pulling-out cable 54, a deflection cable 60 (with upper section 60*a* and lower section 60*b*) guided over deflection rollers 56, 58 fixed to withdrawal pipe 20, and a pulling-in cable 62.

On the operator side and carrier side, steam blower box 12 is in each case provided with a spherical supporting pipe 64 and 66, respectively, which are held in the operator-side mounting 68 and in drive-side mounting 46, respectively.

Figure 6:
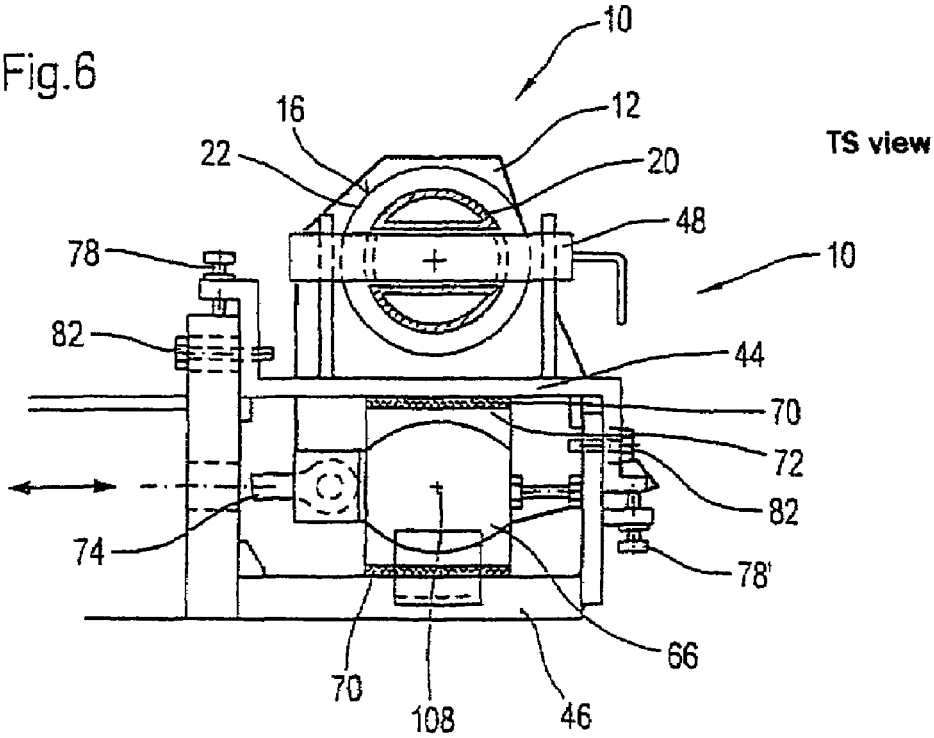
FIG. 6 is a schematic front view of the drive-side end of the steam blower box unit according to FIGS. 3-5.

Mountings 46, 68 can be provided with sliding rails 70 (for example MS, Teflon and so on), the result being mutually opposite sliding planes 72 (see in particular FIG. 6).

Figure 4:
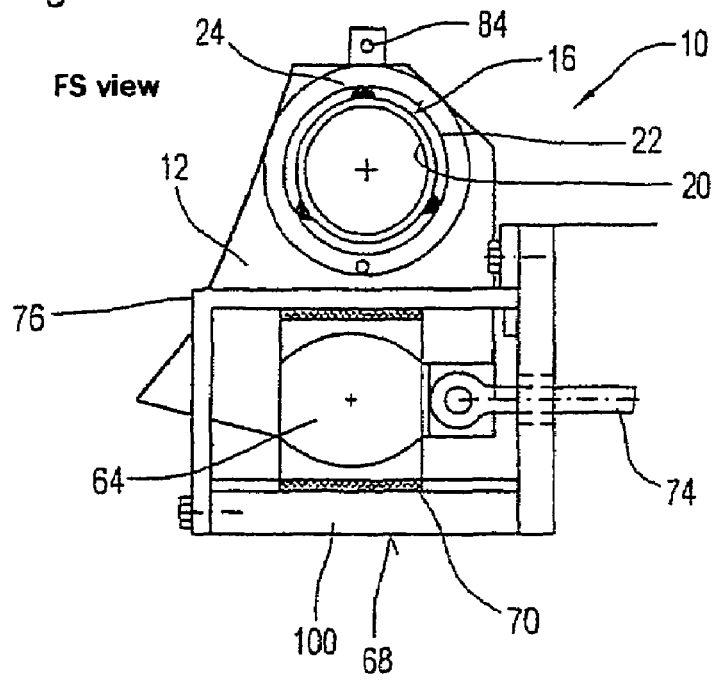
FIG. 4 is a schematic front view of the operator-side end of the steam blower box unit according to FIG. 3.

Steam blower box 12 can be positioned in the desired manner, for example relative to the suction roll 18 (see FIG. 1), for example via hydraulic or lifting cylinders 74 (for example, FIGS. 4 and 6).

The running surfaces of the drive-side and operator-side mountings 46, 68 have a shape that is complementary to the spherical supporting pipes 64, 66.

The spherical shape of the operator-side and drive-side supporting pipes 64 and 66 and also of steam blower box 12 brings with it the advantage that, even after rotation of supporting pipes 64, 66 relative to steam blower box 12 about a common center 108 (see FIG. 6), which may be necessary for the correct setting of steam blower box 12 relative to suction roll 18, appropriate centering is maintained.

Figure 5:
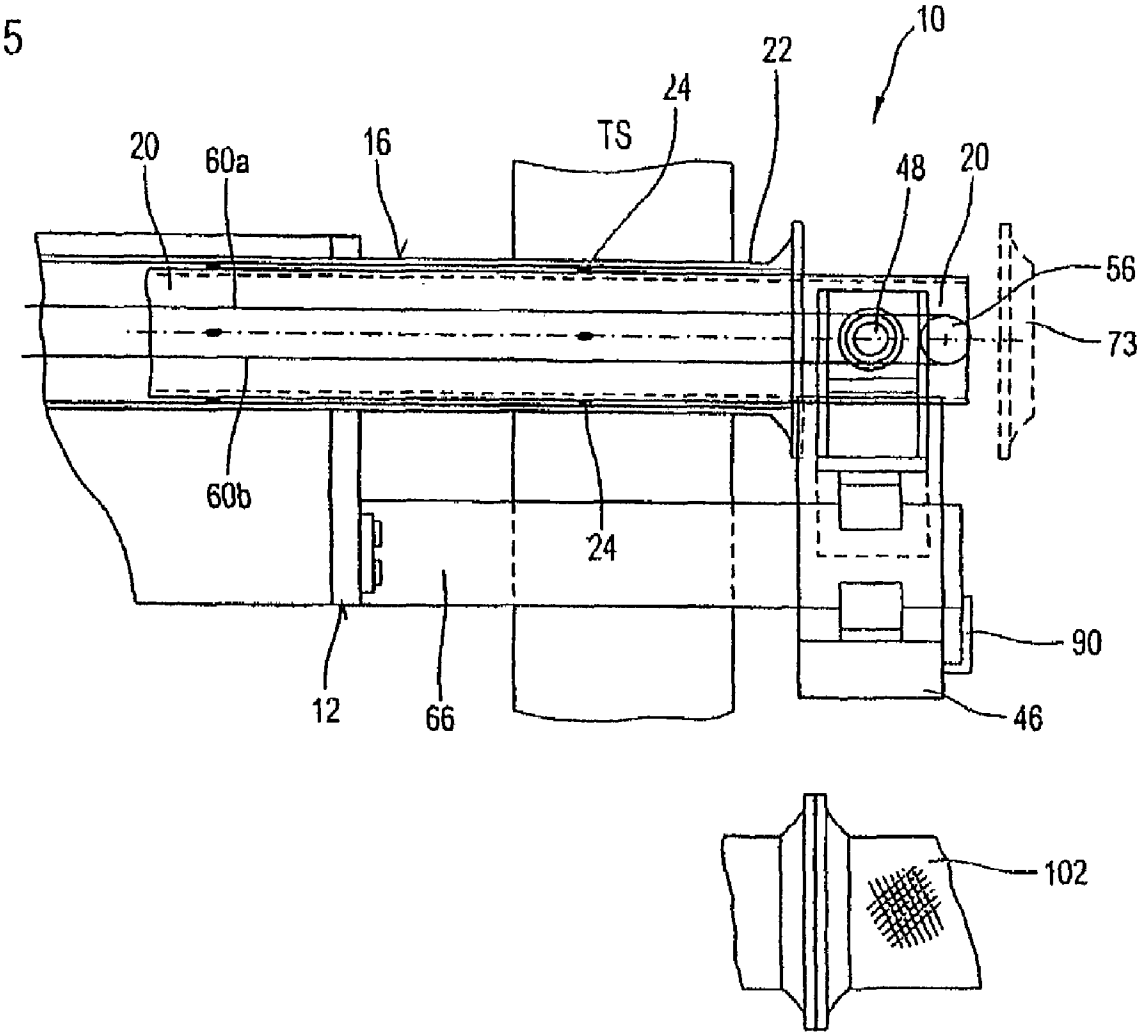
FIG. 5 is a schematic side view of the drive-side end of the steam blower box unit according to FIG. 3.

The lower right-hand part of FIG. 5 shows part of steam supply 102 again in an enlarged illustration.

By way of example, an exemplary removal of steam blower box 12 will be described in the following text by using FIGS. 3-6.

In this case, first of all, for example, the following preparatory measures have to be taken:

- dismantling drive-side steam connection 73;
- dismantling operator-side blind flange 36;
- introducing withdrawal pipe 20, which preferably remains continuously in steam pipe 22 used for steam distribution;
- fixing (securing against rotation) withdrawal pipe 20 to upper part 44 of drive-side mounting 46 by way of a pin 48;
- dismantling operator-side upper bearing part 76;
- dismantling operator-side hydraulic or lifting cylinder 74 from supporting pipe 64 (FIG. 4);
- dismantling drive-side hydraulic or lifting cylinder 74 from supporting pipe 66 (FIG. 6);
- raising steam blower box 12 on the operator side by way of adjusting screws 78 until the operator-side supporting pipe 64 rests on spherical rollers 80 (the left-hand part of FIG. 3);
- loosening fixings screws 82 of drive-side upper bearing part 44 (FIG. 6);
- raising the entire drive-side upper bearing part 44 (FIG. 6) by way of adjusting screws 78, 78' to such an extent that, firstly, upper bearing part 44 is free and then steam blower box 12, including the drive-side supporting pipe 66, is raised slightly.

The steam blower box 12 can then be moved out, for example by way of a machine-house crane, for which purpose the following steps have to be carried out:

- attaching the machine-house crane to the operator-side connecting flange 84;
- providing a trestle 86 in order to support the operator-side part of steam blower box 12, preferably after about one-third of the withdrawal distance.

Pulling out steam blower box 12 implies that the latter will be raised at the operator-side attachment point as a result of the pull. However, since withdrawal pipe 20 is rotatably mounted at the drive-side fixing point by way of fixing pin 48 (in particular FIG. 6), the risk of tilting and/or bending of the entire system including steam blower box 12 and withdrawal pipe 20 is reduced to a minimum or ruled out.

However, steam blower box 12 can also be moved out without a machine-house crane, for example by way of a winch 52. For this purpose, steam blower box unit 10 has in particular a pulling-out cable 54, deflection rollers 56, 58 fixed to withdrawal pipe 20, a deflection cable 60 fixed inside withdrawal pipe 20 and also a pulling-in cable 62.

By way of winding up pulling-out cable 54 by way of winch 52, steam blower box 12 can then be withdrawn appropriately. For such a withdrawal, the following steps in particular are conceivable:

erecting winch 52;

fixing the pulling-out cable 54 to the drive-side flange connection 88;

combining pulling-in cable 62 with upper section 60*a* of deflection cable 60, in particular for subsequent pulling in again;

fixing lower section 60*b* of deflection cable 60 to operator-side connecting flange 88;

providing trestle 86 to support operator-side part of steam blower box 12, preferably after about one-third of the withdrawal distance;

pulling steam blower box 12 out by way of winch 52.

Steam blower box 12 can be moved in by winding up pulling-in cable 62. After steam blower box 12 has been pulled in, deflection cable 60 including the sections or part lengths 60*a*, 60*b* remains inside withdrawal pipe 20. The installed position which is finally reached is achieved by way of an end stop 92 on drive-side mounting 46.

Figure 8:
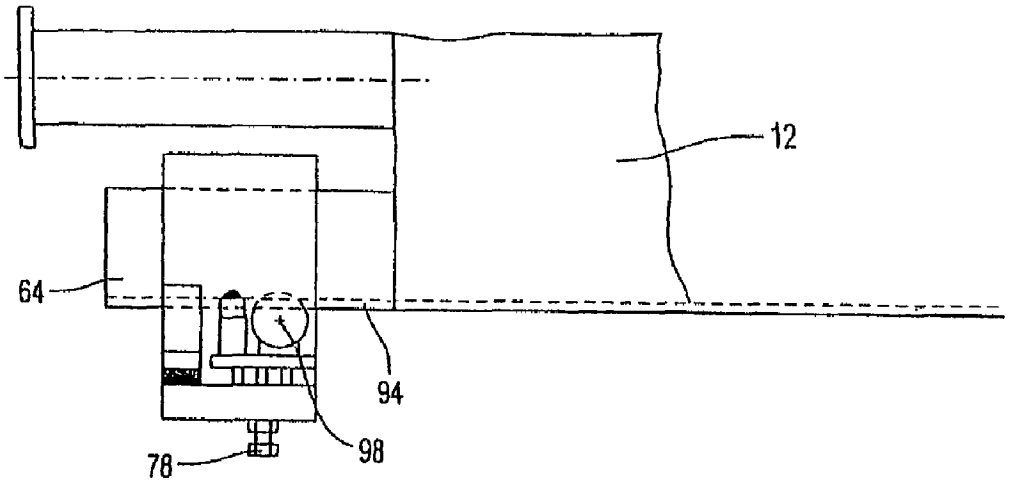
FIG. 8 is a sectional view of the steam blower box unit according to FIG. 7, sectioned along line A-A.
Figure 7:
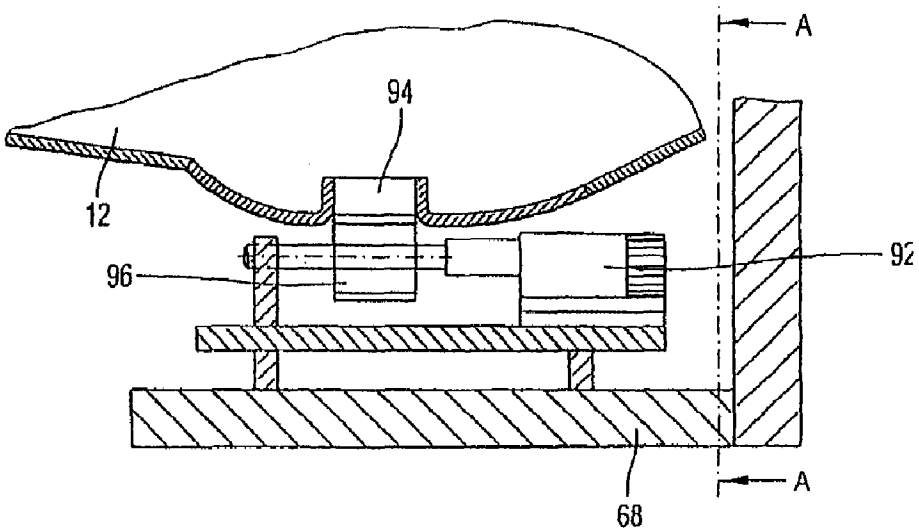
FIG. 7 is a schematic partial illustration of a further embodiment of the steam blower box unit having a rack mechanism, according to the present invention.

Instead of by way of a machine-house crane or a winch, steam blower box 12 can also be moved out and in again via a rack mechanism 92 (see FIGS. 7 and 8), for example. Corresponding moving in and out is possible during the operation of the papermaking machine.

The underside of steam blow box 12 and the underside of the operator-side supporting pipe 64 are preferably provided with a rack 94.

Steam blower box 12 is moved out by way of rack mechanism 92 on the operator-side mounting 68. For this purpose, driven pinion 96 is brought into engagement with rack 94. Drive 98 can be seen in particular in FIG. 8.

In order to move the steam blower box out in this way, in particular the following steps can be provided:

raising rack mechanism 92 by way of adjusting screws 78 on the operator-side lower bearing part 100 until pinion 96 engages in rack 94;

providing trestle 86 (see also FIG. 3) in order to support the operator-side part of steam blower box 12, preferably after about one-third of the withdrawal distance;

enabling rack mechanism 92 to start in order to move steam blower box 12 out.

Figure 9:
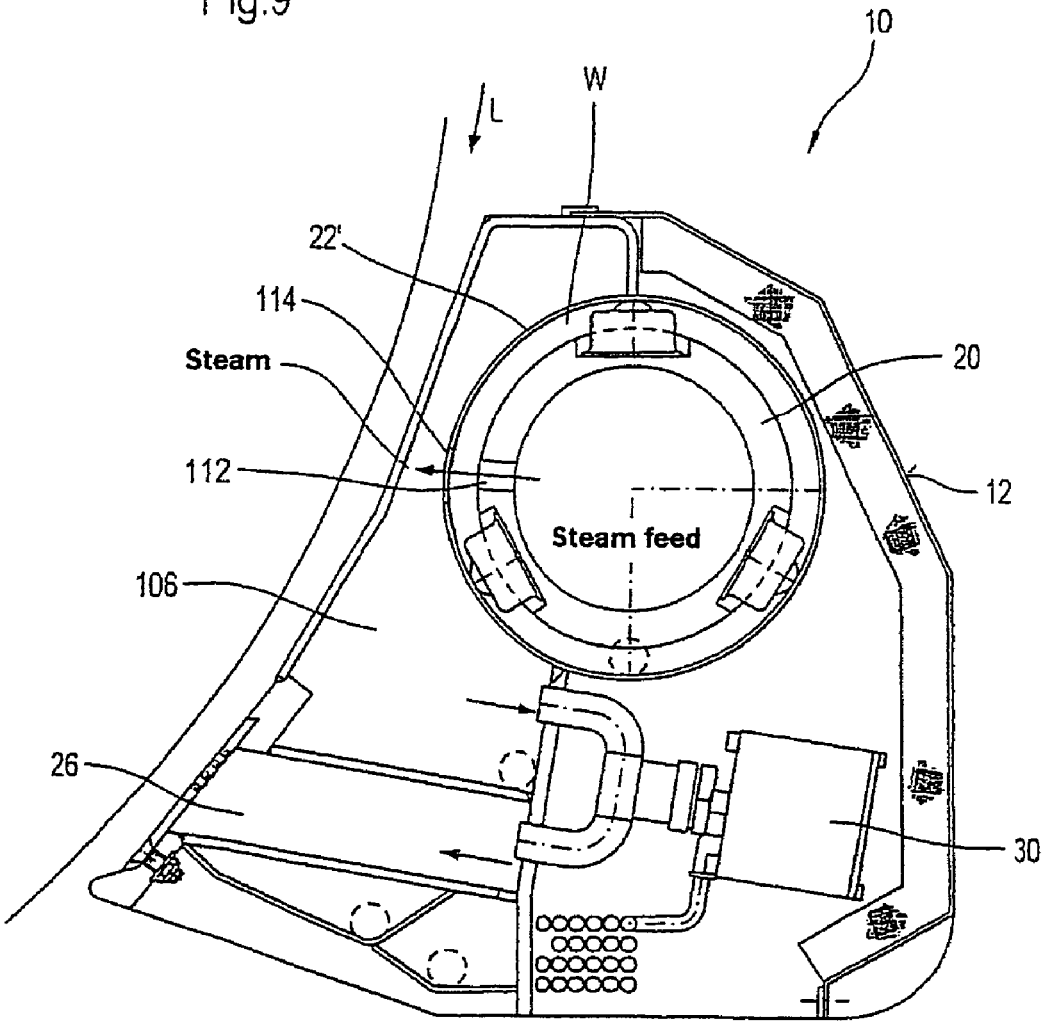
FIG. 9 is a schematic cross-sectional view of a further embodiment of the steam blower box unit, in which the withdrawal pipe is used simultaneously as the steam feed, according to the present invention.
Figure 10:
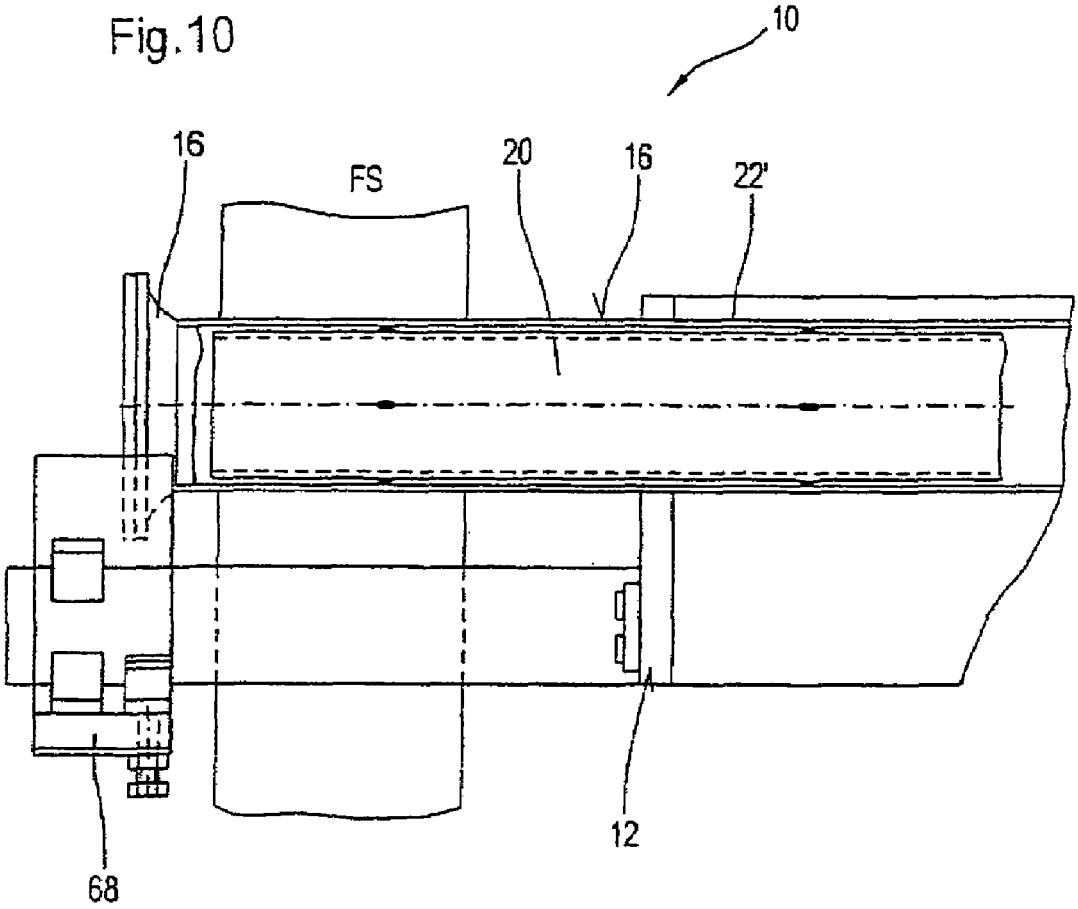
FIG. 10 is a schematic side view of the operator-side end of the steam blower box unit according to FIG. 9.
Figure 11:
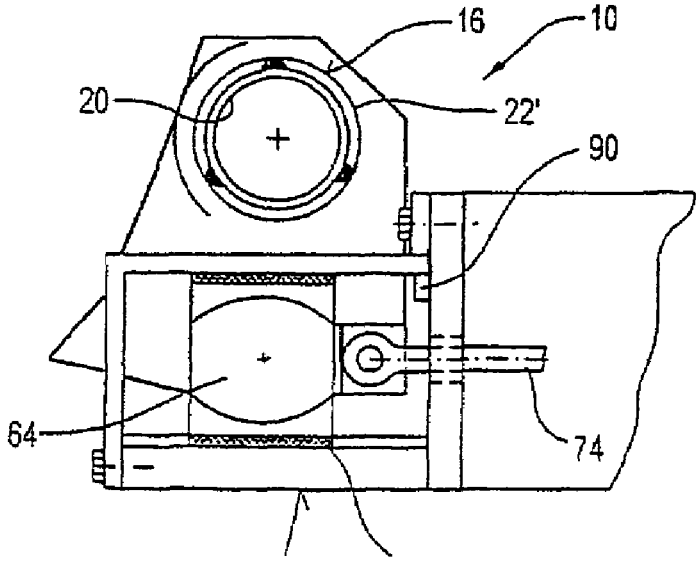
FIG. 11 is a schematic front view of the operator-side end of the steam blower box unit according to FIG. 9.
Figure 12:
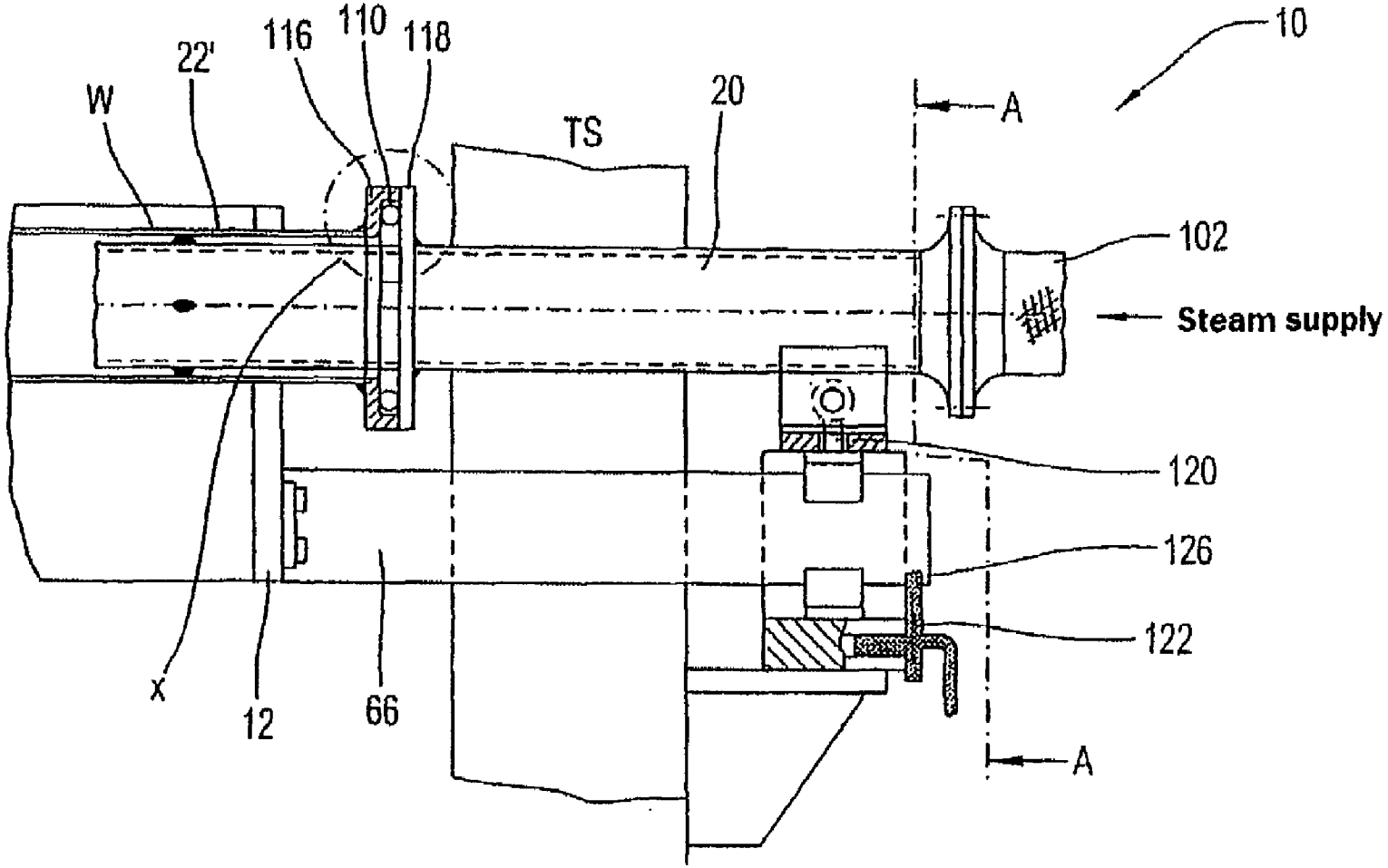
FIG. 12 is a schematic, partly sectioned side view of the drive-side end of the steam blower box unit according to FIG. 9.
Figure 13:
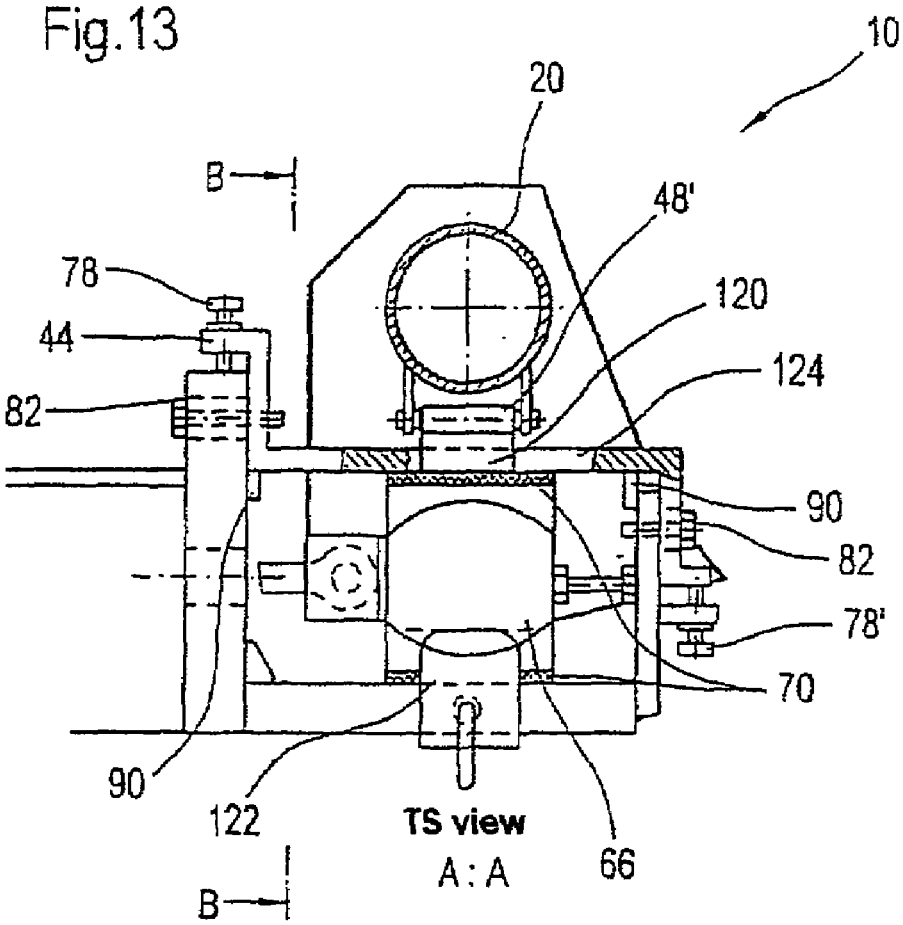
FIG. 13 is a schematic cross-sectional illustration of the drive-side end of the steam blower box unit according to FIG. 9, sectioned along line A-A of FIG. 12.
Figure 14:
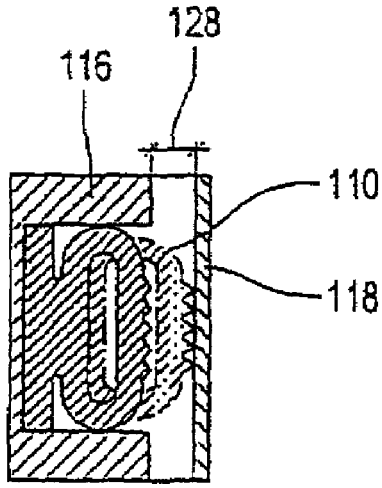
FIG. 14 is an enlarged cross-sectional view of the inflatable ring seal which can be seen in FIG. 12, sectioned along the line B-B in FIG. 13.

FIG. 9 shows, in a schematic cross-sectional illustration, a further embodiment of steam blower box unit 10, in which withdrawal pipe 20 is used simultaneously for the steam feed. In this case, the withdrawal pipe 20 preferably remains in the steam blower box 12 even during the operation of the latter. As can be seen from FIG. 9, withdrawal pipe 20 is inserted into a supporting pipe 22' which extends generally transversely with respect to web running direction L and belongs to steam blower box 12.

As can be seen in particular also from FIGS. 10-14, region W between withdrawal pipe 20 and supporting pipe 22' is preferably sealed off by an inflatable ring seal 110.

Since the steam connection 102 on the drive side no longer has to be dismantled, more rapid removal is possible. One possible procedure during such a removal will be described in more detail further below.

Withdrawal pipe 20 can remain permanently installed. Region W between withdrawal pipe 20 and supporting pipe 22' is sealed off, as already mentioned, preferably by way of an inflatable ring seal 110. It is therefore no longer necessary for any flange connections to be released. In principle, however, a flange connection is also possible.

In the present embodiment, reproduced in FIGS. 9-14, there is for example a steam run from steam connection 102 into withdrawal pipe 20, through holes 112 in withdrawal pipe 20 into region W (see in particular FIG. 9), through holes 114 in supporting pipe 22' into steam distribution chamber 106 and via the actuating valves or zone regulating valves 30 into corresponding zone chambers 26. Withdrawal pipe 20 and supporting pipe 22' are connected to each other by inflatable ring seal 110 or alternatively, for example, by a flange.

In order to ensure tightness, the two contact surfaces 116, 118 on supporting pipe 22' and on withdrawal pipe 20 must not be displaced when ring seal 110 is inflated. This can be ensured as follows, for example: withdrawal pipe 20 is guided in a groove 124 within drive-side upper bearing part 44 by way of a flat steel plate 120, which is fixed to the underside of locking pin 48'. Drive-side bearing supporting pipe 66, which is firmly connected to steam blower box 12 and thus to supporting pipe 25', is guided in a groove 126 in the region of the drive-side bearing supporting pipe 66 by way of locking pin 122. The movements of locking pin 122 relative to bearing supporting pipe 66 and of withdrawal pipe 20 relative to driver-side upper bearing part 44 are not impaired when steam blower box 12 is pivoted in and out.

The removal of steam blower box 12 can, for example, include the following steps:

work on the operator side as already described;

work on the drive side:

closing the compressed air supply for ring seal 110;

rotating locking pin 122 through 90° loosening fixing screws 82;

raising the drive-side upper bearing part 44 by means of adjusting screws 78 (drive-side bearing supporting pipe 66 is free), withdrawal pipe 20 remains fixed in position but is mounted such that it continues to be movable via locking pin 122;

removal as already described.

The installation of the steam blower box can, for example, include the following steps:

moving steam blower box 12 in as already described;

moving steam blower box 12 in until contact surface 116 of supporting pipe 22' strikes the annular flange or the contact surface 118 of the withdrawal pipe 20, the necessary working region 128 is thus defined exactly;

working on the operator side as described;

working on the drive side:

lowering steam blower box 12 via adjusting screws 78 as far as stops 90 fixed to drive-side mounting 46;

fixing the position by way of fixing screws 82;

locking steam blower box 12 by way of locking pin 122;

securing locking pin 122 against sliding out;

opening the compressed air supply for inflatable ring seal 110.

Otherwise, this embodiment can again have, at least substantially, the same construction as the embodiments described previously. Mutually corresponding parts are assigned the same designations.

FIGS. 15-21 show, in a schematic illustration, a further embodiment of steam blower box unit 10, in which steam blower box 12 is in each case provided on the operator side and drive side with a supporting element 64 and 66, respectively, which rests on an operator-side and drive-side sliding rail 130 and 132, respectively, during operation.

Figure 15:
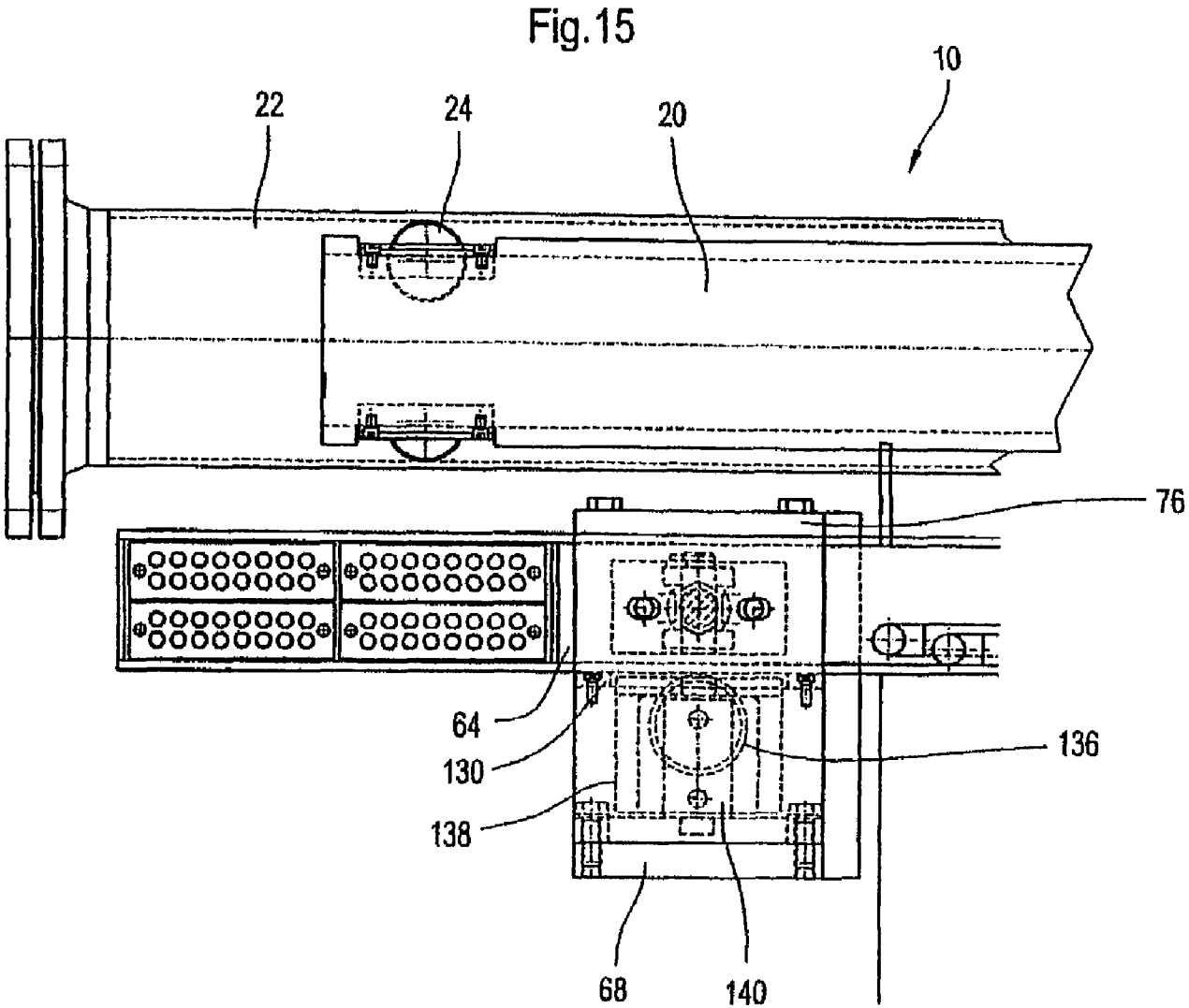
FIG. 15 is a schematic side view of the operator-side end of a further embodiment of the steam blower box unit, according to the present invention.
Figure 20:
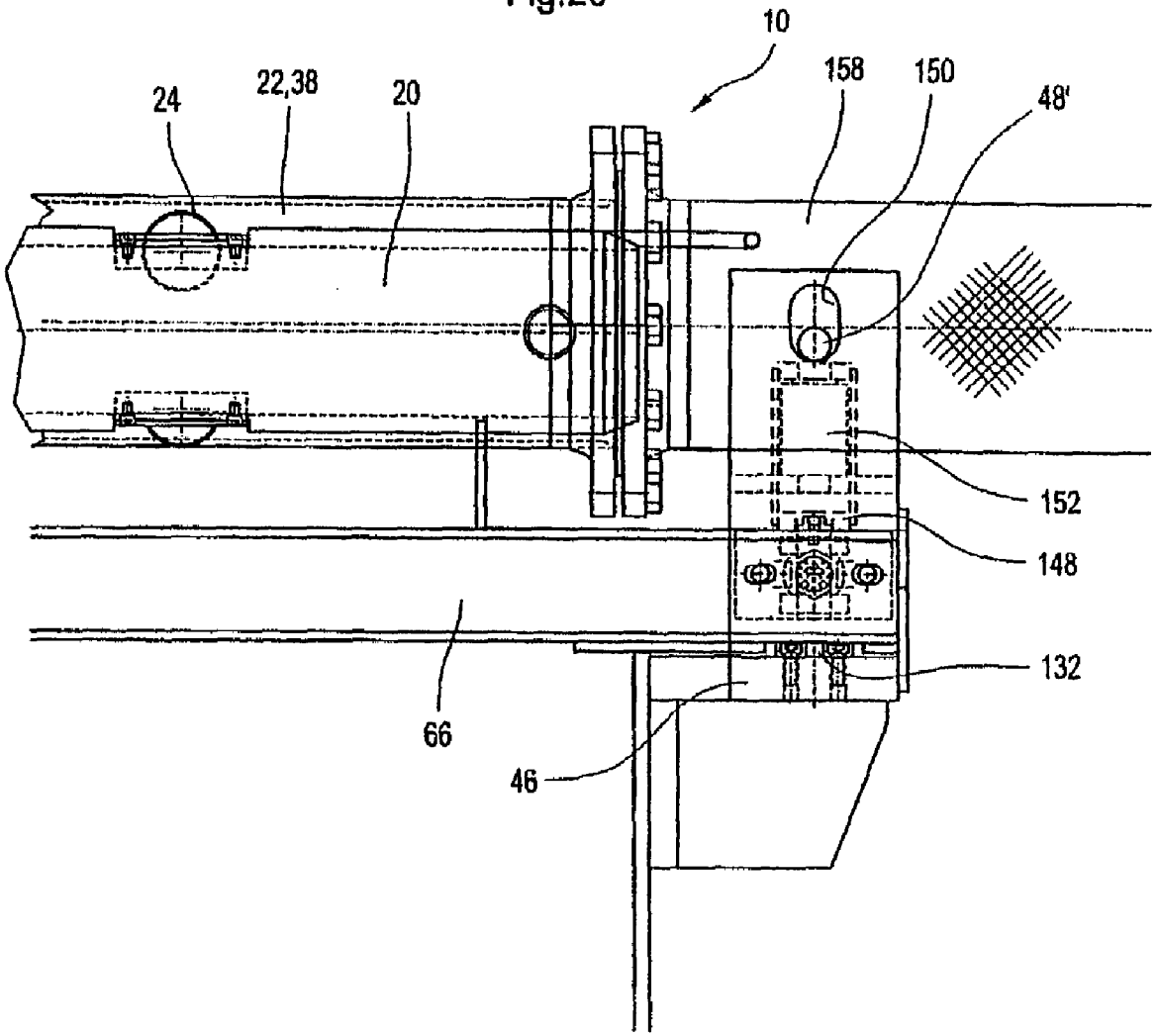
FIG. 20 is a schematic side view of the drive-side end of the steam blower box unit according to FIG. 15.
Figure 21:
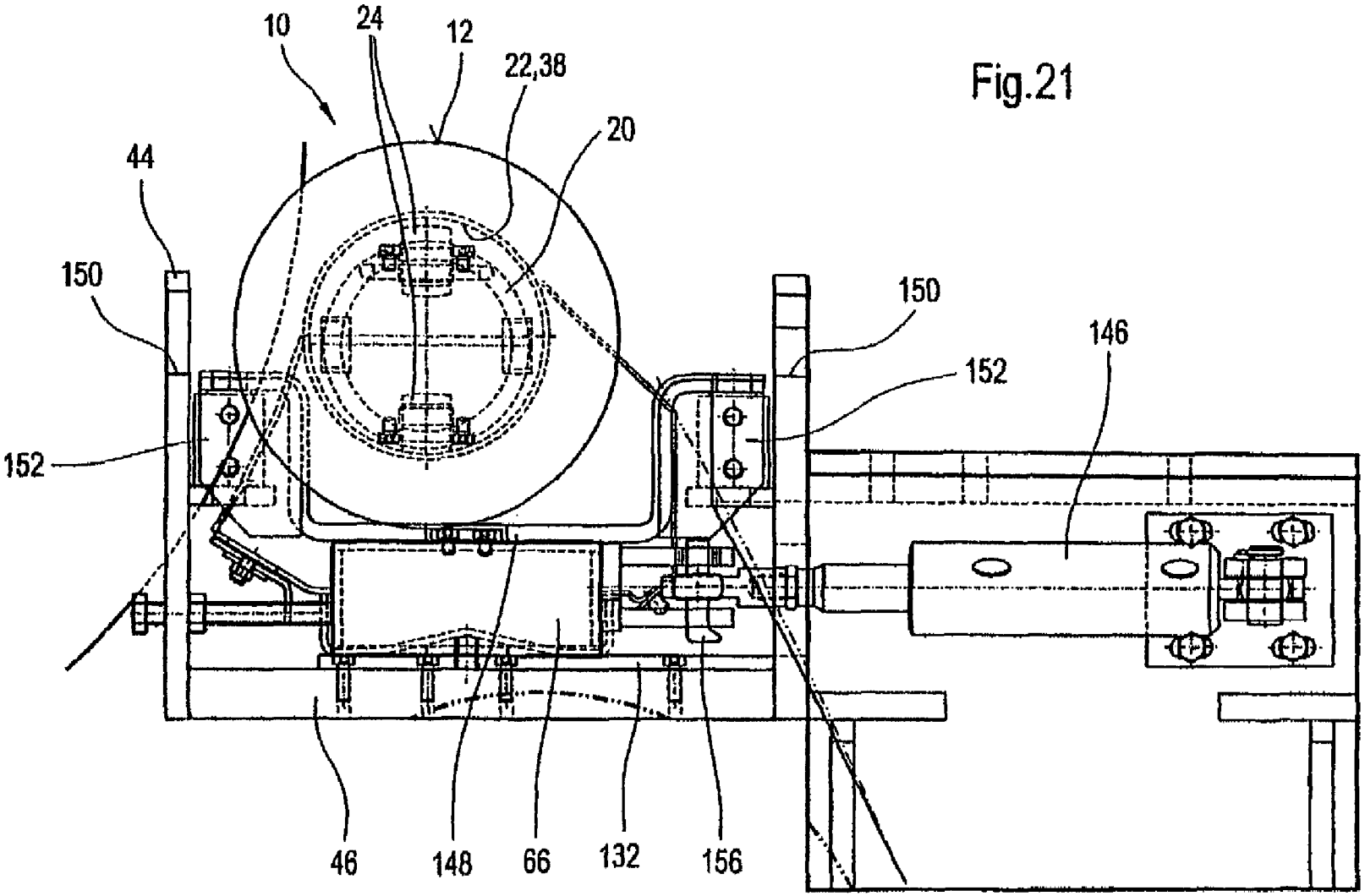
FIG. 21 is a schematic side view of the drive-side end of the steam blower box unit according to FIG. 15.

The operator side is reproduced in FIGS. 15-19. Here, FIG. 15 shows the operator-side end of steam blower box unit 10 in a schematic side view, this operator-side end being reproduced in a schematic front view in FIG. 16. The operator-side mounting of this further embodiment of the steam blower box unit is reproduced in an enlarged side view in FIG. 17, in an enlarged front view in FIG. 18 and in an enlarged plan view in FIG. 19. FIGS. 20 and 21 show the drive side. Here, the drive-side end of steam blower box unit 10 is reproduced in a schematic side view in FIG. 20 and in a schematic front view in FIG. 21. As can be seen from these FIGS. 15 to 21, the respective sliding rail 130, 132 is assigned to the operator-side and drive-side mounting 68 and 46. In this case, the respective sliding rail 130, 132 can in each case be firmly connected to the operator-side and drive-side mounting 68 and 46, respectively. Steam blower box 12 can be adjusted on slide rails 130, 132, for example between an operating position placed closer to passing material web 14 and a maintenance position further removed from the latter.

In order to adjust steam blower box 12 between the operating position and the maintenance position, in each case an actuating device 134 in particular including at least one piston/cylinder unit (see in particular FIG. 16) and 146 (see in particular FIG. 21) is provided on the operator side and drive side. In the present exemplary embodiment, these actuating devices 134, 146 in each case include at least one hydraulic cylinder.

Figure 16:
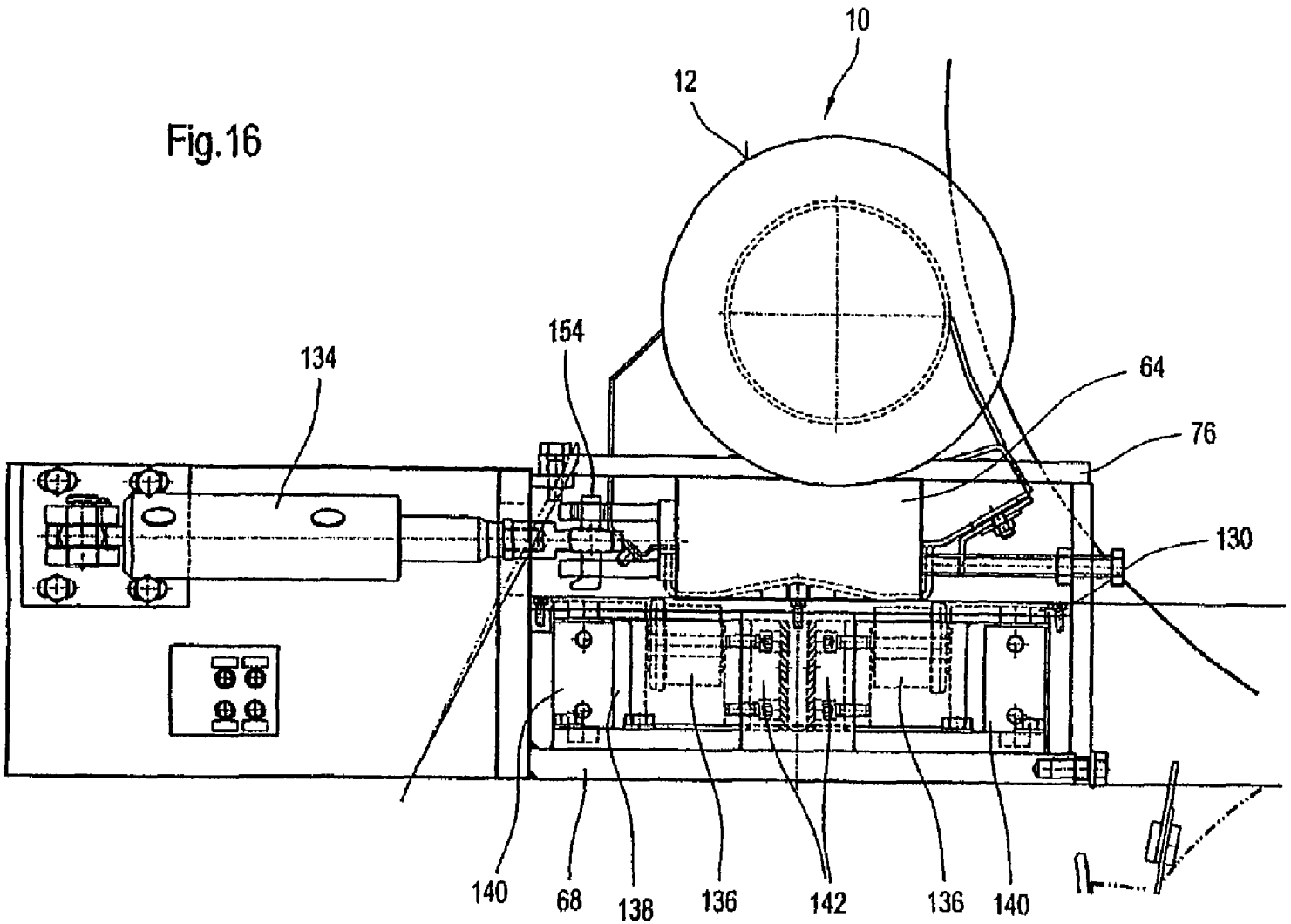
FIG. 16 is a schematic front view of the operator-side end of the steam blower box unit according to FIG. 15.
Figure 17:
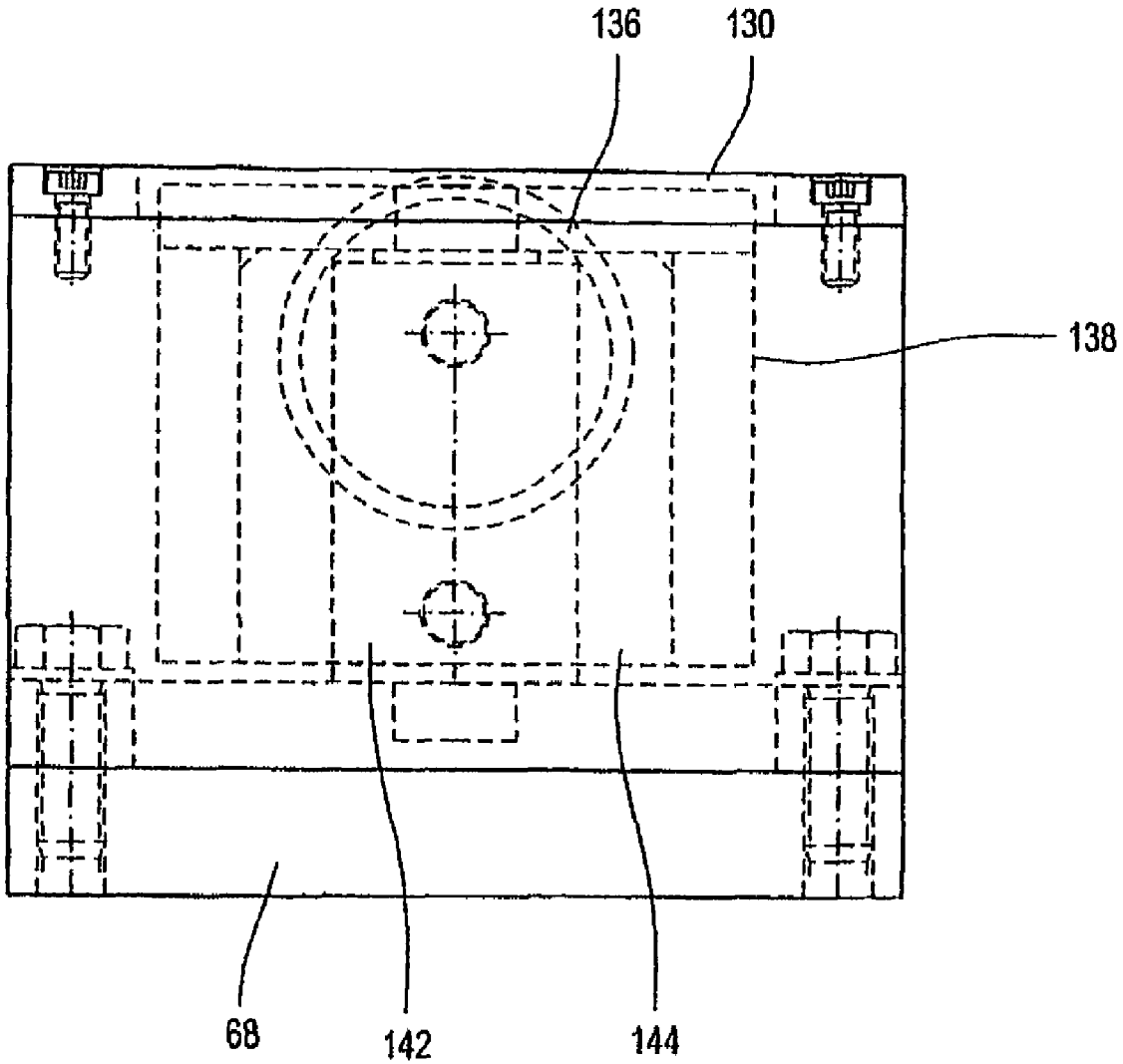
FIG. 17 is an enlarged side view of the operator-side mounting of the steam blower box unit according to FIG. 15.
Figure 18:
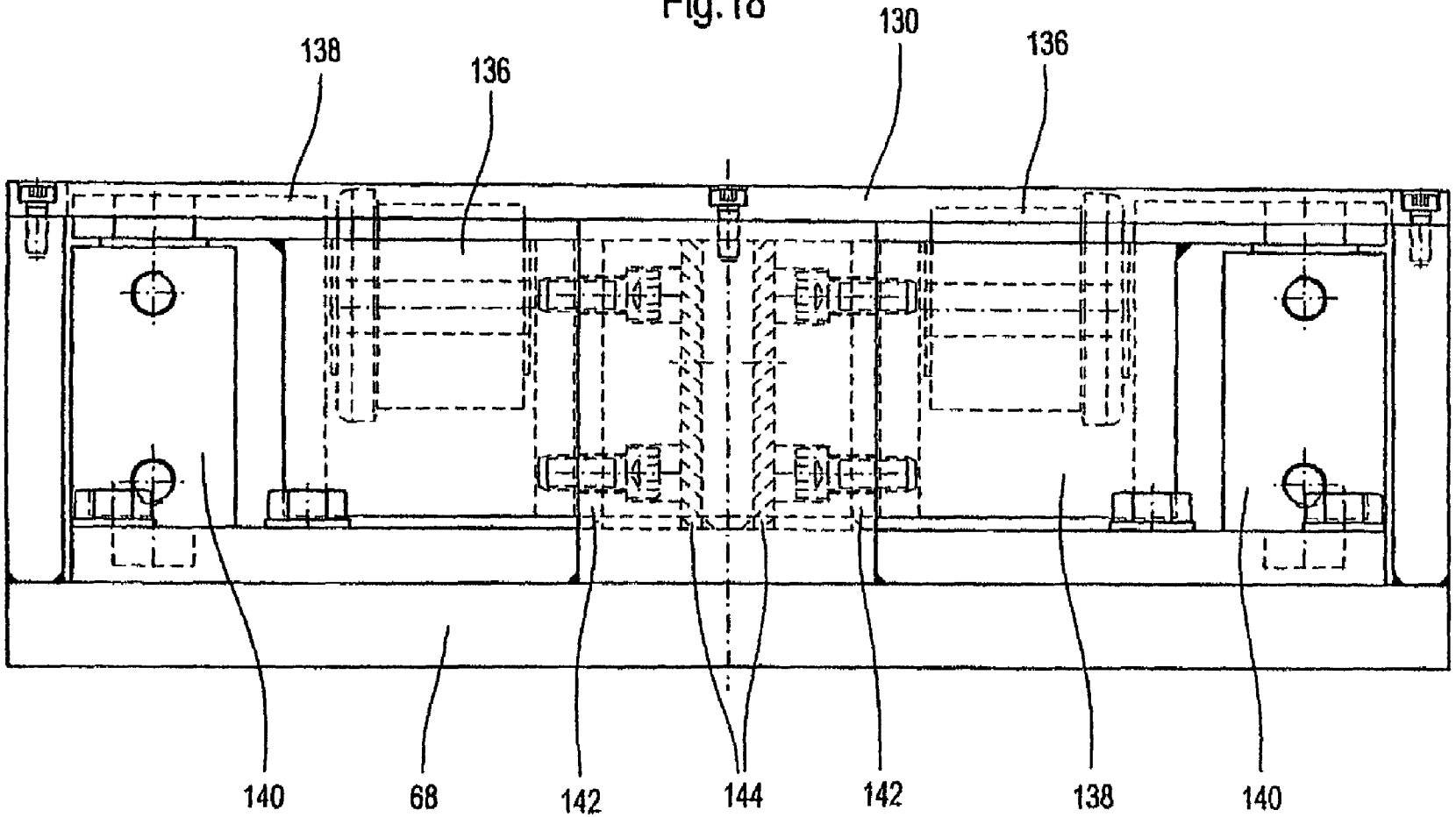
FIG. 18 is an enlarged front view of the operator-side mounting of the steam blower box unit according to FIG. 15.

As can be seen in particular again from FIGS. 16 and 21, the operator-side actuating device 134 can be connected in particular to the operator-side supporting element 64, and the drive-side actuating device 146 can be connected in particular to the drive-side supporting element 66. In this case, as will be described in more detail further below, in each case in particular a releasable connection is provided between actuating device and supporting element.

Figure 19:
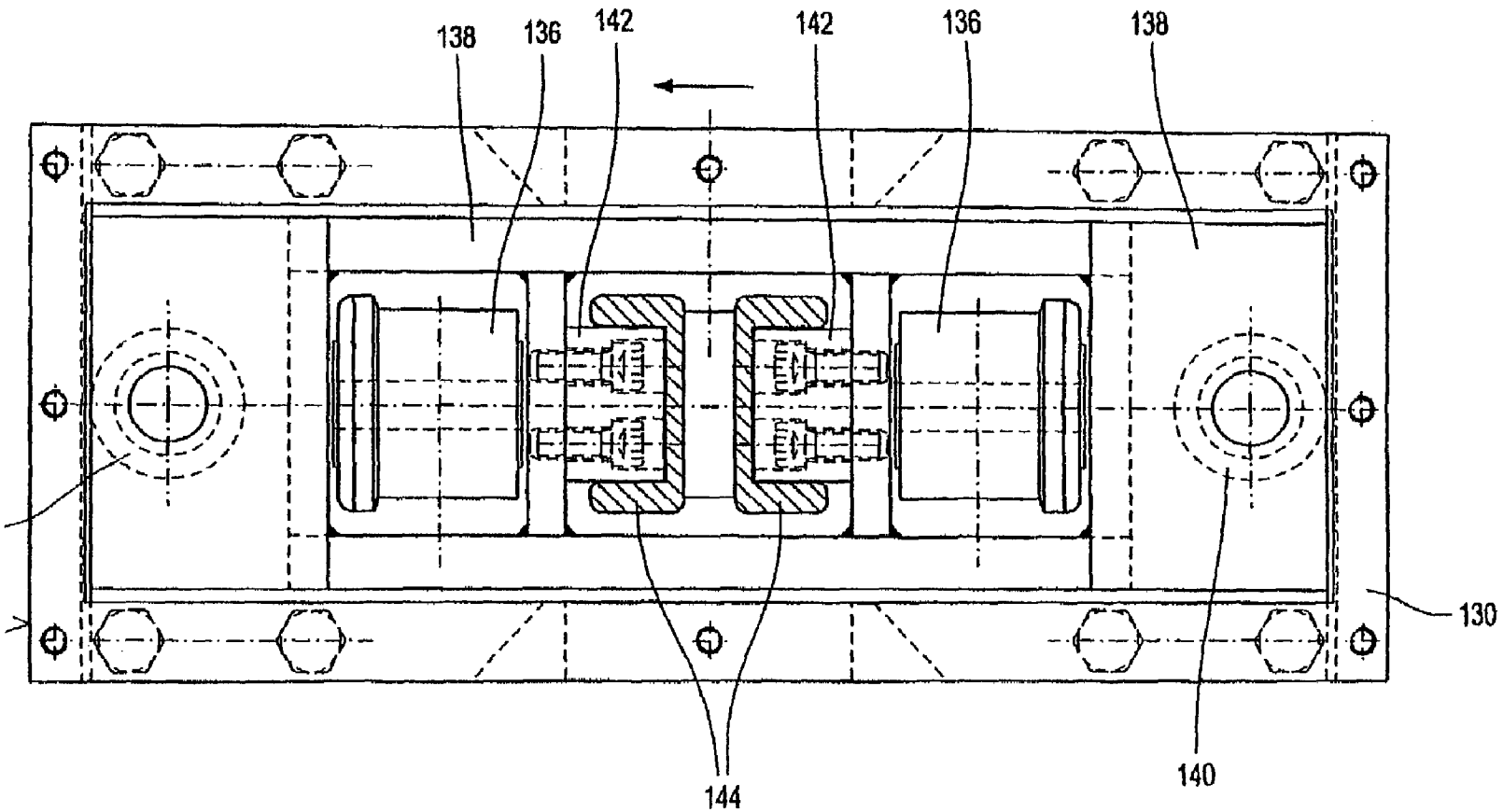
FIG. 19 is an enlarged plan view of the operator-side mounting of the steam blower box unit according to FIG. 15.

As can be seen by way of example from FIG. 19, sliding rail 130 can in particular be designed in the manner of a frame. Supporting elements 64, 66 can be formed to be at least substantially flat, at least on the side facing the respective sliding rail 130, 132 (see for example FIGS. 16 and 21). In principle, these supporting elements 64, 66 can again be provided as supporting pipes, for example.

As can be seen from FIGS. 15 to 19, a lifting frame 138 provided with running rollers 136 is provided on the operator side. In the present case, lifting frame 138 is provided with two running rollers 136, for example. This operator-side lifting frame 138 can be raised such that running rollers 136 come into contact with operator-side supporting element 64 and operator-side supporting element 64 lifts off operator-side sliding rail 130. In this case, this operator-side lifting frame 138 can be raised by an actuating device which, in the present exemplary embodiment, includes two piston/cylinder units or lifting cylinders 140.

Operator-side lifting frame 138 can therefore be adjusted, in particular relative to operator-side mounting 68, by piston/cylinder units 140. In this case, guide elements 142 firmly connected to operator-side lifting frame 138 can be guided in guides 144 having in particular a U-shaped cross-section (see in particular FIGS. 16-19). Guides 144 can in particular be firmly connected to operator-side mounting 68.

As steam blower box 12 is moved out laterally from its operating or maintenance position, generally transversely with respect to web running direction L, and as it is moved in again, operator-side supporting element 64 is therefore able to roll on running rollers 136 assigned to operator-side lifting frame 138. As is revealed, for example, by FIG. 16, operator-side mounting 68 has an upper part 76 which, in particular, can be dismantled in order to move steam blower box 12 out laterally.

In particular in order to move steam blower box 12 out laterally in this way, the connection between steam blower box 12 or operator-side supporting element 64 and operator-side actuating device 134, here a hydraulic cylinder, for example, also has to be releasable. For this purpose, in the present exemplary embodiment, for example a pin 154 has to be removed (see for example again FIG. 16).

As can be seen from FIGS. 20 and 21, in order to adjust the steam blower box between the operating position and the maintenance position, an actuating device 146 comprising at least one piston/cylinder unit or at least one hydraulic cylinder, for example, is again also provided on the drive side. In the present exemplary embodiment, this actuating device 146 comprises a hydraulic cylinder. This drive-side actuating device 146 is in particular releasably connected to drive-side supporting element 66. In particular in order to move steam blower box 12 out laterally, the connection between this or the drive-side supporting element 66 and the drive-side actuating device 146 can again be released, for example, by a pin 156 being removed (see in particular again FIG. 21).

On the drive side, a lifting frame 148 is provided, which can be raised in such a way that the drive-side supporting element 66 connected to it lifts off the drive-side sliding rail 132. As drive-side lifting frame 148 is raised, at the same time the drive-side end of withdrawal aid 20 provided with running rollers 24 is also raised. In the process, at least one of running rollers 24 of withdrawal aid 20 comes into contact with the inner wall of steam distribution chamber 22 or the additional removal pipe 38.

As drive-side lifting frame 148 is raised, the entire drive-side end of steam blower box 12 is also finally raised. In the process, in the present exemplary embodiment, as drive-side lifting frame 148 is raised, a locking pin 48' which passes through the drive-side end of withdrawal aid 20 and is guided in slots 150 in the drive-side mounting 46 is acted on or carried along, and the drive-side end of withdrawal aid 20 is also raised via this locking pin 48'.

Drive-side lifting frame 148 can be raised via an actuating device which here, by way of example, includes two piston/cylinder units or lifting cylinders 152. Via this actuating device 152, drive-side lifting frame 148 can be adjusted, in particular relative to drive-side mounting 46.

The embodiment of the steam blower box unit reproduced in FIGS. 15-21 therefore includes a mounting for moving steam blower box 12 out and for adjusting steam blower box 12 between an operating position and a maintenance position.

On the operator side, a sliding rail 130 is provided, in particular one like a frame, on which the supporting element or supporting pipe 64 rests during operation and, with the aid of actuating device 134, slides from the operating position into the maintenance position and vice versa.

Moreover, on the operator side there is provided a lifting frame 138, to which running rollers 136 and guide elements 142 are firmly connected. This operator-side lifting frame 138 is raised by actuating device 140, for example including two hydraulic cylinders, before steam blower box is removed, as a result of which running rollers 136 come into contact with the supporting element or supporting pipe 64 and thus lift the steam blower box off sliding rail 130. Guide elements 142 are guided, for example in U-shaped guides 144. Before the withdrawal, the other bearing part 76 must be dismantled and the connection to actuating device 134, for example including a hydraulic cylinder, must be released.

The work on the operator-side mounting therefore includes the following steps, for example:

- dismantling upper bearing part 76;
- dismantling lifting cylinder pin 154;
- retracting lifting cylinder 134;
- raising the system by way of lifting cylinder 140 (for example by 17 mm).

The total stroke of, for example, 17 mm can in particular be made up as follows:

- 7 mm for raising the withdrawal attachment until it makes contact with the steam blower box;
- 10 mm for raising the entire system.

The work on the drive-side mounting can include the following steps, for example:

dismantling flexible steam line 158 (FIG. 20);
dismantling lifting cylinder pin 156 (FIG. 21);
retracting lifting cylinder 146;
positioning the withdrawal aid or withdrawal pipe 20 relative to the hole or slots 150 in the upper part 44 of drive-side mounting 46 by pulling out withdrawal aid 20;
inserting locking pin 48' through the holes or slots 150 in the upper bearing part 44;
securing the system (withdrawal aid 20/steam blower box 12) with spring cotters which, for example, are put through the locking pin 48' and secure the latter in the desired position;
raising drive-side lifting frame 148 (for example by 22 mm) by way of the actuating device 152, for example including two short-stroke cylinders.

The total stroke of, for example, 22 mm can in particular be made up as follows:

4 mm distance between upper bearing part 44 and locking pin 48';
8 mm distance between upper running roller 24 and inner wall of steam distribution chamber 22 or additional withdrawal pipe 38;
10 mm for raising the entire system.

Otherwise, the embodiment reproduced in FIGS. 15-21 can at least substantially again have, for example, a construction such as has been described in connection with the other embodiments.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

10 Steam blower box unit
12 Steam blower box
14 Material web
16 Withdrawal device
18 Suction roll
20 Withdrawal aid, withdrawal pipe
20' Withdrawal aid
22 Steam pipe
22' Supporting pipe
24 Running rollers, spherical rollers
26 Zone chamber
28 Steam outlet plate
30 Actuating valve
32 Dewatering device
34 Insulation
36 Blind flange
38 Removal pipe
40 T-shaped support
42 Valve
44 Drive-side upper bearing part
46 Drive-side mounting
48 Pin
48' Locking pin
50 Connection
52 Winch
54 Pulling-out cable
56 Deflection roller
58 Deflection roller
60 Deflection cable
62 Pulling-in cable
64 Operator-side supporting pipe, supporting element
66 Drive-side supporting pipe, supporting element
68 Operator-side mounting
70 Sliding rail
72 Sliding plane
73 Drive-side steam connection
74 Hydraulic or lifting cylinder
76 Operator-side upper bearing part
78 Adjusting screw
78' Adjusting screw
80 Spherical rollers
82 Fixing screw
84 Operator-side connecting flange
86 Trestle
88 Operator-side flange connection
90 End stop
92 Rack mechanism
94 Rack
96 Pinion
98 Drive
100 Operator-side lower bearing part
102 Steam supply, steam connection
104 Holes
106 Steam distribution chamber
108 Common center
110 Inflatable ring seal
112 Hole
114 Hole
116 Contact surface on supporting pipe 22'
118 Annular flange on withdrawal pipe 20, contact surface
120 Flat steel plate belonging to locking pin 48'
122 Locking pin
124 Groove in drive-side upper bearing part 44
126 Groove in drive-side bearing supporting pipe 66
128 Working region of the ring seal
130 Operator-side sliding rail
132 Drive-side sliding rail
134 Operator-side actuating device, piston/cylinder unit
136 Running roller of the operator-side lifting frame
138 Operator-side lifting frame
140 Operator-side actuating device, piston/cylinder unit
142 Guide element
144 U-shaped guide
146 Drive-side actuating device, piston/cylinder unit
148 Drive-side lifting frame
150 Slots
152 Drive-side actuating device, piston/cylinder unit
154 Pin
156 Pin
158 Flexible steam line
FS Operator side
L Web running direction
TS Drive side

What is claimed is:

1. A steam blower box unit for applying steam to a passing fiber material web, comprising:

a steam blower box being located opposite the material web, said steam blower box having an operating position;

a withdrawal device at least partly integrated in said steam blower box via which said steam blower box is moved out of said operating position generally transversely, and thus generally in a cross-machine direction, with respect to a web running direction into a lateral position, said steam blower box being moved into said operating position again from said lateral position, said withdrawal device including a withdrawal aid which is at least partially positioned inside of said steam blower box.

2. The steam blower box unit of claim 1, wherein said fiber material web is one of a paper web and a board web.

3. The steam blower box unit of claim 1, wherein said steam blower box is moved out of said operating position laterally with respect to said web running direction.

4. The steam blower box unit of claim 1, wherein an entire said steam blower box is moved appropriately by said withdrawal device.

5. The steam blower box unit of claim 1, wherein said withdrawal aid is inserted into said steam blower box and is that by which said steam blower box is guided as said steam blower box is moved out of said operating position and moved into said operating position.

6. The steam blower box unit of claim 5, wherein said withdrawal aid has an elongated shape and when in an inserted state extends generally transversely with respect to said web running direction.

7. The steam blower box unit of claim 5, wherein said withdrawal aid is inserted into said steam blower box in order to move said steam blower box at least one of out of said operating position and into said operating position and then said withdrawal aid is removed.

8. The steam blower box unit of claim 5, wherein said withdrawal aid remains inserted in said steam blower box even during an operation of said steam blower box.

9. The steam blower box unit of claim 5, wherein said steam blower box further includes a steam distribution chamber which extends generally transversely with respect to said web running direction, said withdrawal aid is inserted into said steam distribution chamber.

10. The steam blower box unit of claim 9, wherein said steam distribution chamber is a steam pipe.

11. The steam blower box unit of claim 5, wherein said steam blower box further includes an additional removal pipe which extends generally transversely with respect to said web running direction, said withdrawal aid is inserted into said additional removal pipe.

12. The steam blower box unit of claim 5, wherein said steam blower box further includes a steam distribution chamber and an additional removal pipe, one of said steam distribution chamber and said additional removal pipe is formed in such a way that said steam blower box is moved out and in laterally and is guided by said withdrawal aid.

13. The steam blower box unit of claim 5, wherein said steam blower box includes an upper part available as a space for said withdrawal aid.

14. The steam blower box unit of claim 5, wherein said withdrawal aid includes a withdrawal pipe.

15. The steam blower box unit of claim 14, further including at least one relevant holder associated with said steam blower, said withdrawal pipe and said at least one relevant holder being of spherical design.

16. The steam blower box unit of claim 5, wherein said steam blower box includes a support which extends generally transversely with respect to said web running direction and is T-shaped in cross-section, said withdrawal aid interacts with said support in order to move said steam blower box out and in of said operating position.

17. The steam blower box unit of claim 16, further including a plurality of running rollers being provided between said withdrawal aid and one of a wall of said steam distribution chamber and said support.

18. The steam blower box unit of claim 5, wherein said withdrawal aid is inserted into an upper region of said steam blower box.

19. The steam blower box unit of claim 5, wherein said withdrawal device includes at least one of a pulling-out cable, a deflection cable guided over a plurality of deflection rollers fixed to said withdrawal aid, and a pulling-in cable.

20. The steam blower box unit of claim 5, wherein said withdrawal aid is a withdrawal pipe used simultaneously for a steam feed.

21. The steam blower box unit of claim 20, wherein said the withdrawal pipe remains inserted in said steam blower box during an operation of said steam blower box.

22. The steam blower box unit of claim 20, wherein said steam blower box includes a supporting pipe which extends generally transversely with respect to said web running direction, said withdrawal pipe is inserted into said supporting pipe.

23. The steam blower box unit of claim 22, further including a region between said withdrawal pipe and said supporting pipe being sealed off by an inflatable ring seal.

24. The steam blower box unit of claim 1, wherein said steam blower box includes an operator side and a support side, said steam blower box is provided on each of said operator side and said support side with a spherical supporting pipe which is held in a respective mounting which includes a plurality of running surfaces having a shape complementary to each of said spherical supporting pipe.

25. The steam blower box unit of claim 1, further including an operator side associated with said steam blower box, said steam blower box being withdrawn in a direction of said operator side.

26. The steam blower box unit of claim 25, further including an upper part of a drive-side mounting of said steam blower box; and said withdrawal aid being inserted into said steam blower box and being that by which said steam blower box is guided as said steam blower box is moved out of said operating position and moved in said operating position, said withdrawal aid being fixed axially to said upper part of said drive-side mounting.

27. The steam blower box unit of claim 26, wherein said withdrawal aid is simultaneously secured against rotation about a longitudinal axis of said withdrawal aid.

28. The steam blower box unit of claim 27, wherein said withdrawal aid is simultaneously pivoted about a horizontal axis which is perpendicular to said longitudinal axis.

* * * * *